US012565695B2

(12) United States Patent
Boselli et al.

(10) Patent No.: US 12,565,695 B2
(45) Date of Patent: Mar. 3, 2026

(54) 2XXX SERIES ALUMINUM LITHIUM ALLOYS

(75) Inventors: Julien Boselli, Pittsburgh, PA (US); Roberto J. Rioja, Murrysville, PA (US); Gregory B. Venema, Bettendorf, IA (US); Ralph R. Sawtell, Gibsonia, PA (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 813 days.

(21) Appl. No.: 13/399,975

(22) Filed: Feb. 17, 2012

(65) Prior Publication Data

US 2012/0225271 A1 Sep. 6, 2012

Related U.S. Application Data

(60) Provisional application No. 61/444,093, filed on Feb. 17, 2011.

(51) Int. Cl.

| | |
|---|---|
| ***C22C 21/12*** | (2006.01) |
| ***C22C 21/00*** | (2006.01) |
| ***C22C 21/16*** | (2006.01) |
| ***C22C 21/18*** | (2006.01) |

(Continued)

(52) U.S. Cl.

CPC ..... *C22C 21/00* (2013.01); *C22C 21/12* (2013.01); *C22C 21/16* (2013.01); *C22C 21/18* (2013.01); *C22F 1/04* (2013.01); *C22F 1/057* (2013.01)

(58) Field of Classification Search

CPC ..... C22C 21/16; C22C 21/18; C22C 21/12

See application file for complete search history.

(56) References Cited

U.S. PATENT DOCUMENTS

| | | | | |
|---|---|---|---|---|
| 1,620,082 | A | 3/1927 | Czochralski | 420/531 |
| 2,381,219 | A | 8/1945 | Le Baron | 420/529 |
| 2,915,391 | A | 12/1959 | Criner | 148/439 |

(Continued)

FOREIGN PATENT DOCUMENTS

| | | |
|---|---|---|
| CN | 101967588 | 2/2011 |
| CN | 101967588 A | 2/2011 |

(Continued)

OTHER PUBLICATIONS

Davis, J.R. ASM International, "Aluminum and Aluminum Alloys", p. 126, 300-303. (Year: 1993).*

(Continued)

*Primary Examiner* — George Wyszomierski
*Assistant Examiner* — Janell C Morillo
(74) *Attorney, Agent, or Firm* — Greenberg Traurig, LLP

(57) ABSTRACT

Thick wrought 2xxx aluminum lithium alloy products are disclosed. The wrought aluminum alloy products have a thickness of at least 12.7 mm and contain from 3.00 to 3.80 wt. % Cu, from 0.05 to 0.35 wt. % Mg, from 0.975 to 1.385 wt. % Li, wherein $-0.3*Mg-0.15Cu+1.65 \leq Li \leq -0.3*Mg-0.15Cu+1.85$, from 0.05 to 0.50 wt. % of at least one grain structure control element, wherein the grain structure control element is selected from the group consisting of Zr, Sc, Cr, V, Hf, other rare earth elements, and combinations thereof, up to 1.0 wt. % Zn, up to 1.0 wt. % Mn, up to 0.12 wt. % Si, up to 0.15 wt. % Fe, up to 0.15 wt. % Ti, up to 0.10 wt. % of any other element, with the total of these other elements not exceeding 0.35 wt. %, the balance being aluminum.

6 Claims, 22 Drawing Sheets

(51) Int. Cl.
*C22F 1/04* (2006.01)
*C22F 1/057* (2006.01)

(56) References Cited

U.S. PATENT DOCUMENTS

| | | | | |
|---|---|---|---|---|
| 3,288,601 | A | 11/1966 | Flemings et al. | 420/535 |
| 3,475,166 | A | 10/1969 | Raffin | 420/532 |
| 3,563,730 | A | 2/1971 | Bach et al. | 420/402 |
| 3,876,474 | A | 4/1975 | Watts et al. | 420/533 |
| 3,925,067 | A | 12/1975 | Sperry et al. | 420/535 |
| 4,094,705 | A | 6/1978 | Sperry et al. | 420/533 |
| 4,526,630 | A | 7/1985 | Field | 148/700 |
| 4,584,173 | A | 4/1986 | Gray et al. | 420/533 |
| 4,588,553 | A | 5/1986 | Evans et al. | 420/533 |
| 4,594,222 | A | 6/1986 | Heck et al. | 420/529 |
| 4,597,792 | A | 7/1986 | Webster | 75/249 |
| 4,603,029 | A | 7/1986 | Quist et al. | 420/535 |
| 4,624,717 | A | 11/1986 | Miller | 148/693 |
| 4,626,409 | A | 12/1986 | Miller | 420/533 |
| 4,635,842 | A | 1/1987 | Mohondro | 228/175 |
| 4,648,913 | A | 3/1987 | Hunt, Jr. et al. | 148/693 |
| 4,661,172 | A | 4/1987 | Skinner et al. | 419/28 |
| 4,717,068 | A | 1/1988 | Meyer | 228/203 |
| 4,735,774 | A | 4/1988 | Narayanan et al. | 420/533 |
| 4,752,343 | A | 6/1988 | Dubost et al. | 148/502 |
| 4,758,286 | A | 7/1988 | Dubost et al. | 148/695 |
| 4,772,342 | A | 9/1988 | Polmear | 148/418 |
| 4,795,502 | A | 1/1989 | Cho | 148/693 |
| 4,797,165 | A | 1/1989 | Bretz et al. | 148/695 |
| 4,801,339 | A | 1/1989 | Osborn et al. | 419/29 |
| 4,806,174 | A | 2/1989 | Cho et al. | 148/693 |
| 4,812,178 | A | 3/1989 | Dubost | 148/695 |
| 4,816,087 | A | 3/1989 | Cho | 148/692 |
| 4,832,910 | A | 5/1989 | Rioja et al. | 420/528 |
| 4,840,682 | A | 6/1989 | Curtis et al. | 148/695 |
| 4,840,683 | A | 6/1989 | Dubost | 148/549 |
| 4,842,822 | A | 6/1989 | Colvin et al. | 420/533 |
| 4,844,750 | A | 7/1989 | Cho et al. | 148/693 |
| 4,848,647 | A | 7/1989 | Gentry et al. | 228/262 |
| 4,851,192 | A | 7/1989 | Baba et al. | 420/528 |
| 4,863,528 | A | 9/1989 | Brown et al. | 148/695 |
| 4,869,870 | A | 9/1989 | Rioja et al. | 420/532 |
| 4,894,096 | A | 1/1990 | Meyer | 148/502 |
| 4,897,126 | A | 1/1990 | Bretz et al. | 148/697 |
| 4,915,747 | A | 4/1990 | Cho | 148/693 |
| 4,921,548 | A | 5/1990 | Cho | 148/693 |
| 4,955,413 | A | 9/1990 | Meyer et al. | 148/502 |
| 4,961,792 | A | 10/1990 | Rioja et al. | 148/552 |
| 5,032,359 | A | 7/1991 | Pickens et al. | 420/533 |
| 5,066,342 | A | 11/1991 | Rioja et al. | 148/693 |
| 5,076,859 | A | 12/1991 | Rioja et al. | 148/698 |
| 5,108,519 | A | 4/1992 | Armanie et al. | 148/689 |
| 5,116,572 | A | 5/1992 | Narayanan et al. | 420/533 |
| 5,122,339 | A | 6/1992 | Pickens et al. | 420/533 |
| 5,135,713 | A | 8/1992 | Rioja et al. | 420/532 |
| 5,137,686 | A | 8/1992 | Rioja et al. | 420/528 |
| 5,151,136 | A | 9/1992 | Witters et al. | 148/689 |
| 5,198,045 | A | 3/1993 | Cho et al. | 148/552 |
| 5,211,910 | A | 5/1993 | Pickens et al. | 420/532 |
| 5,234,662 | A | 8/1993 | Balmuth et al. | 420/529 |
| 5,259,897 | A | 11/1993 | Pickens et al. | 148/417 |
| 5,389,165 | A | 2/1995 | Cho | 148/552 |
| 5,393,357 | A | 2/1995 | Cho | 148/437 |
| 5,439,536 | A | 8/1995 | Cho | 148/697 |
| 5,455,003 | A * | 10/1995 | Pickens et al. | |
| 5,462,712 | A | 10/1995 | Langan et al. | 420/528 |
| 5,512,241 | A | 4/1996 | Kramer et al. | 420/528 |
| 6,551,424 | B1 | 4/2003 | Haszler et al. | 148/552 |
| 7,229,509 | B2 | 6/2007 | Cho | 148/417 |
| 7,438,772 | B2 | 10/2008 | Rioja et al. | 148/417 |
| 8,118,950 | B2 | 2/2012 | Colvin et al. | 148/417 |
| 2002/0015658 | A1 | 2/2002 | Rioja et al. | 420/540 |
| 2002/0134474 | A1 | 9/2002 | Cho | 148/699 |
| 2003/0226935 | A1 | 12/2003 | Garratt et al. | 428/598 |
| 2004/0071586 | A1 | 4/2004 | Rioja et al. | 420/529 |
| 2005/0006008 | A1 * | 1/2005 | Cho | C22C 21/16 420/533 |
| 2005/0189048 | A1 | 9/2005 | Cho | 148/699 |
| 2007/0181229 | A1 | 8/2007 | Bes et al. | 148/438 |
| 2007/0258847 | A1 | 11/2007 | Cho | 420/533 |
| 2008/0289728 | A1 | 11/2008 | Bes | 148/552 |
| 2008/0292491 | A1 | 11/2008 | Fridlyander et al. | 420/533 |
| 2009/0159159 | A1 * | 6/2009 | Danielou et al. | |
| 2010/0180992 | A1 | 7/2010 | Giummarra et al. | 148/698 |
| 2010/0314007 | A1 * | 12/2010 | Danielou | C22F 1/057 148/502 |
| 2011/0030856 | A1 | 2/2011 | Warner et al. | 148/552 |

FOREIGN PATENT DOCUMENTS

| | | |
|---|---|---|
| CN | 101967589 | 2/2011 |
| CN | 102021457 | 4/2011 |
| CN | 102021457 A | 4/2011 |
| EP | 0227563 | 7/1987 |
| EP | 0273600 | 7/1988 |
| EP | 1788101 | 5/2007 |
| GB | 0353891 | 7/1931 |
| GB | 0522050 | 6/1940 |
| GB | 869444 | 5/1961 |
| GB | 1090960 | 11/1967 |
| JP | 60-238439 | 11/1985 |
| JP | 61-023751 | 1/1986 |
| JP | 61-133358 | 6/1986 |
| JP | 61-231145 | 10/1986 |
| JP | 64-025954 | 1/1989 |
| JP | 3-107440 | 5/1991 |
| RU | 2237098 | 9/2004 |
| WO | 2009036953 A1 | 3/2009 |
| WO | WO 2009/036953 | 3/2009 |
| WO | WO 2010/149873 | 12/2010 |

OTHER PUBLICATIONS

Timothy Warner; Recently-Developed Aluminium Solutions for Aerospace Applications; Materials Science Forum, vols. 519-521, pp. 1271-1278, Jan. 1, 2006, total pp. 10.

J.R. Davis; Introduction to Aluminum and Aluminum Alloys, ASM Specialty Handbook, Aluminum and Aluminum Alloys, ASM International, Materials Park, Ohio, XP-002728706, Dec. 1993, pp. 40-46, total pp. 9.

Balmuth et al., *Fracture and Fatigue Crack Growth Resistance of Recrystallized Al—Li Alloys*, Materials Science Forum, vol. 217-222, p. 1365-1370 (1996).

Baumann et al., *The effect of Ternary Additions on the δ'/α Misfit and the δ' Solvus Line in Al—Li Alloys*, Department of Metallurgy and Materials Engineering, Lehigh University, in Aluminum-Lithium Alloys II at Monterey, California, p. 17-29 (Apr. 12-14, 1983).

Baumann, S., *Aspects of δ' ($Al_3Li$) Precipitation in Dilute Al—Li Binary and Al—Li—X Temary Alloys*, A Dissertation Presented to the Graduate Committee of Lehigh University in Candidacy for the Degree of Doctor of Philosophy in the Department of Metallurgy and Materials Engineering, p. 1-198 (1983).

Bretz, P., *Aluminum-Lithium Alloys*, Proceedings of the 1987 Aluminum-Lithium Symposium, p. 1-40 (Mar. 25-26, 1987).

Cegedur Trans Alum, High Strength High Ductility Aluminium Based Alloy Comprising Lithium, Copper, and Magnesium as Additives, FR2561261-A, p. 1 (Mar. 15, 1984).

Chester et al., *Precipitation in Al—Cu—Mg—Ag Alloys*, The Metallurgy of Light Alloys, p. 75-81 (1983).

Chester et al., *TEM Investigation of Precipitates in Al—Cu—Mg—Ag and Al—Cu—Mg Alloys*, Micron, vol. 11, p. 311-312 (1980).

Crill, M. J., et al., "Evaluation of AA 2050-T87 Al—Li Alloy Crack Turning Behavior," *Materials Science Forum* 519-521:1323-1328, 2006.

Elagin et al., *Effect of Lithium on the Properties of Al—Zn—Mg Alloys*—, All-Union Institute of Light Alloys, p. 1038-1041 (Dec. 1977).

(56) References Cited

OTHER PUBLICATIONS

Feng et al., *The effect of Minor Alloving Elements on the Mechanical Properties of Al—Cu—Li Alloys*, in Aluminum-Lithium Alloys II at Monterey, California, pp. 235-253 (Apr. 12-14, 1983).
Gayle, F.W., *Alloving Additions and Property Modification in Aluminum-Lithium-X Systems*, Reynolds Metal Company, Metallurgical Research Division, in Aluminum-Lithium Alloys at Stone Mountain, Georgia, pp. 120-139 (May 19-21, 1980).
Gayle, F.W. et al., *High Toughness, High Strength Aluminum Alloy Design and Practice, Aluminium-Lithium*, vol. 1, 1991, publisher DGM Informationsgesellschaft mbH, Germany, pp. 203-208.
Gayle, F.W. et al., *Composition and Anisotropy in Al—Cu—Li—Ag—Mg—Zr Alloys*, Scripta Metallurgica et Materialia, vol. 30, No. 6, pp. 761-766, 1994.
Giummarra, C., et al., "Al—Li Alloys: Development of Corrosion Resistant, High Toughness Aluminum-Lithium Aerospace Alloys," *Proceedings of the 11th Conference on Aluminium Alloys* 1:176-188, Sept. 22-26, 2008.
Hatch, J., *Effects of Alloying Elements and Impurities on Properties*, Aluminum Properties and Physical Metallurgy, ISBN 0-87170-176-6, p. 201-203 (May 1984).
Hayashi et al., *Aging Phenomena of Al—Li—Mg Alloy Affected by Additional Elements*, Journal of Japan Institute of Light Metals, vol. 32, No. 7, p. 350-355 (Jul. 1982). (English Translation p. 1-11).
Hunsicker et al., Stress-Corrosion Resistance of High-Strength Al—Zn—Mg—Cu Alloys with and without Silver Additions, *Metallurgical Transactions*, vol. 3, p. 201-209 (Jan. 1972).
Jones et al., The Mechanical Properties of Aluminium-Lithium Alloys, *Journal of The Institute of Metals*, vol. 88, p. 435-443 (1960).
Kennedy, A. J., The Prospects for Materials, *The Aeronautical Journal of the Royal Aeronautical Society*, vol. 73, No. 697, p. 1-8 (Jan. 1969).
Kilmer, R. J et al., *Effect of Zn Additions on the Precipitation Events and Implications to Stress Corrosion Cracking Behavior in Al—Li—Cu—Mg—Zr Alloys*, Aluminium-Lithium, vol. 2, 1991, publisher DGM Informationsgesellschaft mbH, Germany, pp. 755-760.
Kobayashi, K. et al., *Effect of Zn Addition on Corrosion Resistance of 2090 and 2091 Alloys*, Aluminium-Lithium, vol. 2, 1991, publisher DGM Informationsgesellschaft mbH, Germany, pp. 673-678.
Kojima et al., Effect of Lithium Addition on the Elevated Temperature Properties of 2219 Alloy, *Journal of Japan Institute of Light Metals*, vol. 36, No. 11, p. 737-743 (1986). (English Translation p. 1-16).
Lavernia et al., *Review Aluminium-Lithium Alloys*, Journal of Materials Science, vol. 22, p. 1521-1529 (1987).
Lequeu, P., et al. "Aluminum-Copper-Lithium Alloy 2050 Developed for Medium to Thick Plato," *Journal of Materials Engineering and Performance*, Oct. 2009.
Marchive et al., *Processing and Properties of 2091 and 8090 Forgings*, Journal De Physique, Colloque C3, Tome 48, p. 43-48 (Sep. 1987).
Meister et al., *Welding of Aluminum and Aluminum Alloys*, Defense Metals Information Center, DMIC Report 236, p. 47-49 (Apr. 1, 1967).
Mondolfo, L. F., *Aluminum Alloys: Structure and Properties*, Aluminum-Copper Alloys, ISBN 0408709324, p. 502, 641, 693-725 (1976).
Noble et al., *The Elastic Modulus of Aluminium-Lithium Alloys*, Journal of Materials Science, vol. 17, p. 461-468 (1982).
Pickens, J.R. et al., *The Effect of Zn on Nucleation in Al—Cu_Li—AG—Mg Alloy, Weldalite™ 049 (X2094)*, Aluminium-Lithium, vol. 1, 1991, publisher DGM Informationsgesellschaft mbH, Germany, pp. 357-362.
Polmear et al., *Design and Development of an E tal Wrought Aluminum Alloy for Use at Elevated Temperatures*, Metallurgical Transactions A, vol. 19A, p. 1027-1035 (Apr. 1988).
Polmear, I.J., *Development of an Experimental Wrought Aluminium Alloy for use at Elevated Temperatures*, Aluminum Alloys-Physical and Mechanical Properties, vol. 1, p. 661-674 (Jun. 1986).
Polmear, I.J., *The Effects of Small Additions of Silver on the Aging of Some Aluminum Alloys*, Transactions of the Metallurgical Society of AIME, vol. 230 p. 1331-1339 (Oct. 1964).
Reynolds et al., *The Effect of Thermal Exposure on the Fract for of Aluminum Alloys Intended for Elevated Temperature Service*, Elevated Temperature Effects on Fatigue and Fracture, ASTM STP 1297, p. 191-205 (1997).
Sen et al., *The Effect of an Addition of 0-5 wt% Silver on the Ageing Characteristics of Certain Al—Cu—Mg Alloys*, The Institute of Metals, Monograph and Report Series No. 33, p. 49-53 (1969).
Speidel, M.O., *Development of High-Strength Aluminum Alloys*, 6th International Conference on Light Metals, Loeben/Vienna, p. 67-72 (1975).
Speidel, M.O., *Stress Corrosion Cracking of Aluminum Alloys*, Metallurgical Transactions A, vol. 6A, p. 631-651 (Apr. 1975).
Staley, J.T., *Investigation to Improve the Stress-Corrosion Resistance of Aluminum Aircraft Alloys through Alloy Additions and Specialized Heat Treatment*, Naval Air Systems Command Contract N00019-68-C-0146, Final Report, p. 1-208 (Feb. 28, 1969).
Vietz et al., *The Influence of Small Additions of Silver on the Ageing of Aluminium Alloys: Observations on Al—Cu—Mg Alloys*, Journal of the Institute of Metals, vol. 94, p. 410-419 (1966).
Wang et al., *Lithium Containing 2024 Aluminum Alloys Made From Rapidly-Solidified Powders*, in Aluminum-Lithium Alloys II at Monterey, California, p. 447-467 (Apr. 12-14, 1983).
Department of Defense Handbook: Metallic Materials and Elements for Aerospace Vehicle Structures, No. MIL-HDBK-5J, pp. 9-1 to 9-270, Jan. 31, 2003, Retrieved from the Internet at http://www.everyspec.com on Jun. 30, 2010.
AMS 4413, "Aluminum Alloy, Plate 3.5Cu—1.0Li—.40Mg—.35Mn—.45AG—0.12Zr (2050-T84) Solution Heat Treated, Stress Relieved, and Artifically Aged," SAEAerospace, pp. 1-5, Oct. 2007.
AMS 4328A, "Aluminum Alloy, Plate (2397-T87) 2.8Cu—1.4Li—0.30Mn—0.12Z4—0.10Zn Solution Heat Treated, Cold Worked, and Artificially Aged," SAEAerospace, pp. 1-6, Jan. 2003, revised Jul. 2006.
Davis, J. R.—ASM Handbook, Alloy and Temper Designation Systems, 1993, pp. 29-30, ASM International.
Aluminium and aluminium alloys-wrought products—temper designations, International Standard ISO 2107, Third Edition, 2007, pp. 1-9.
ANSI-H-35.1(M), American National Standard Alloy and Temper Designation Systems for Aluminum, 2009, pp. 1-11.

* cited by examiner

FIG. 1 - Long-Transverse Strength v. Toughness (63-76 mm products)
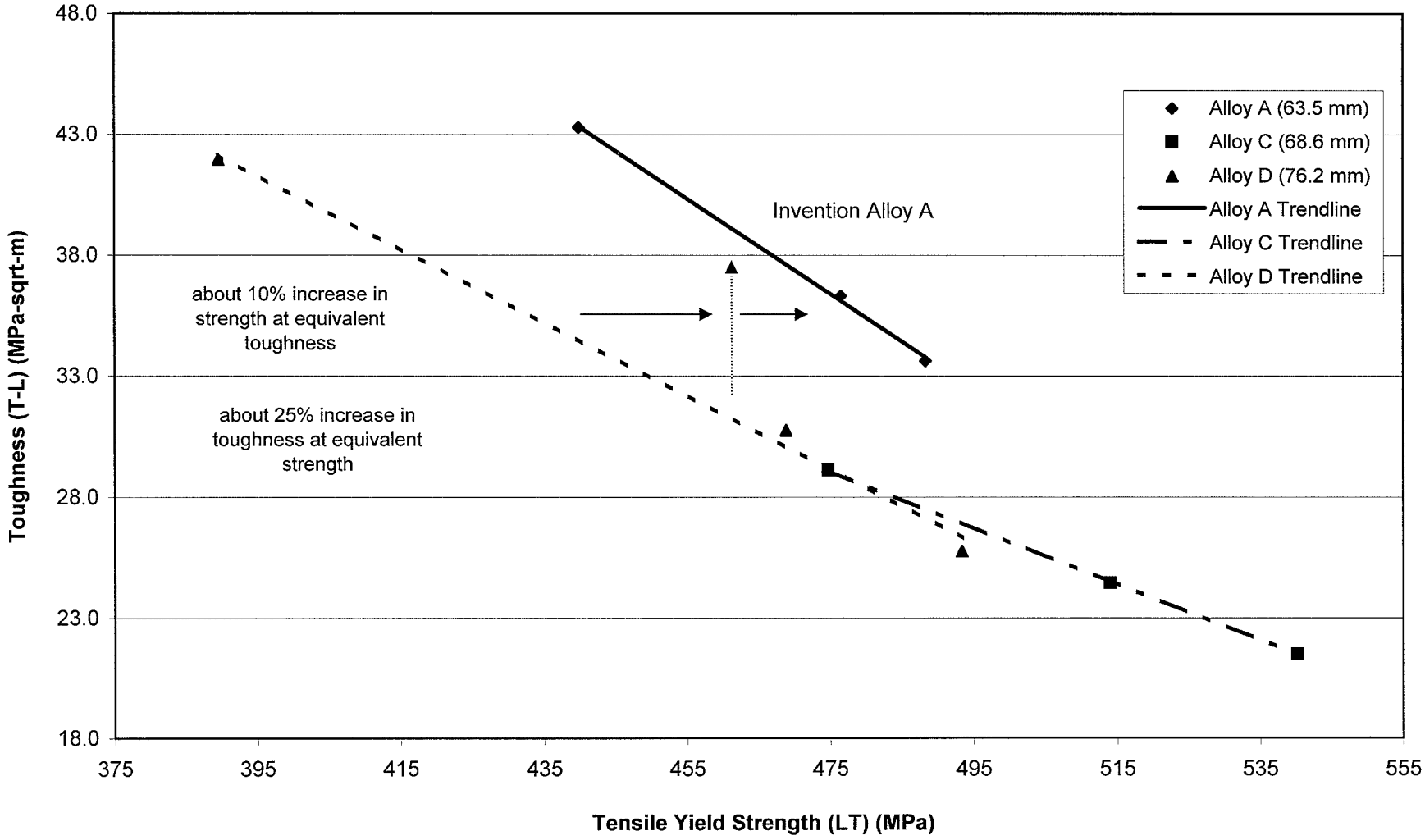

FIG. 2 - Long-Transverse Strength v. Toughness (102 mm products)
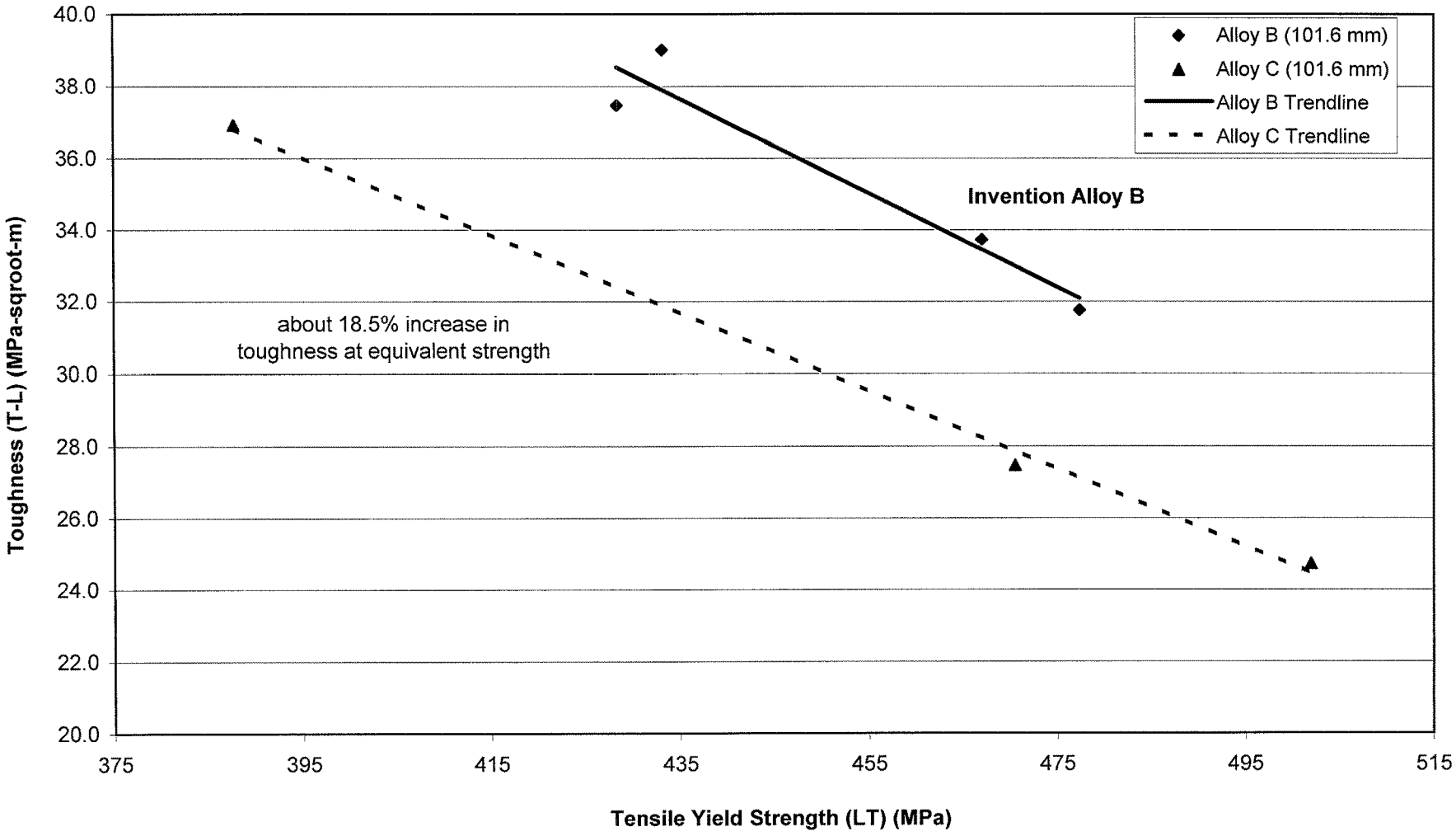

FIG. 3 - Short-Transverse Strength v. Toughness (63 - 76 mm products)
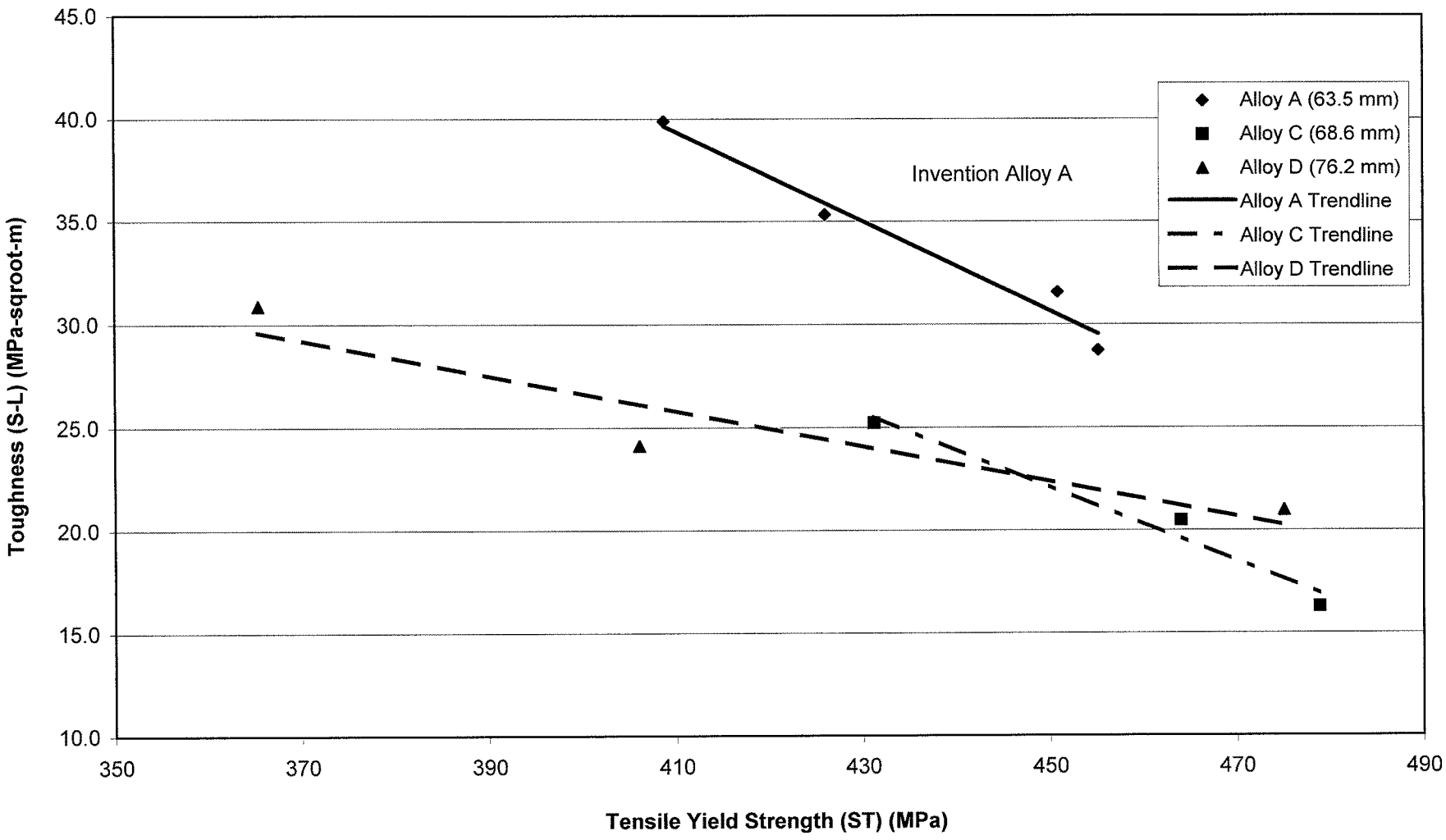

FIG. 4 - Short-Transverse Strength v. Toughness (102 mm products)
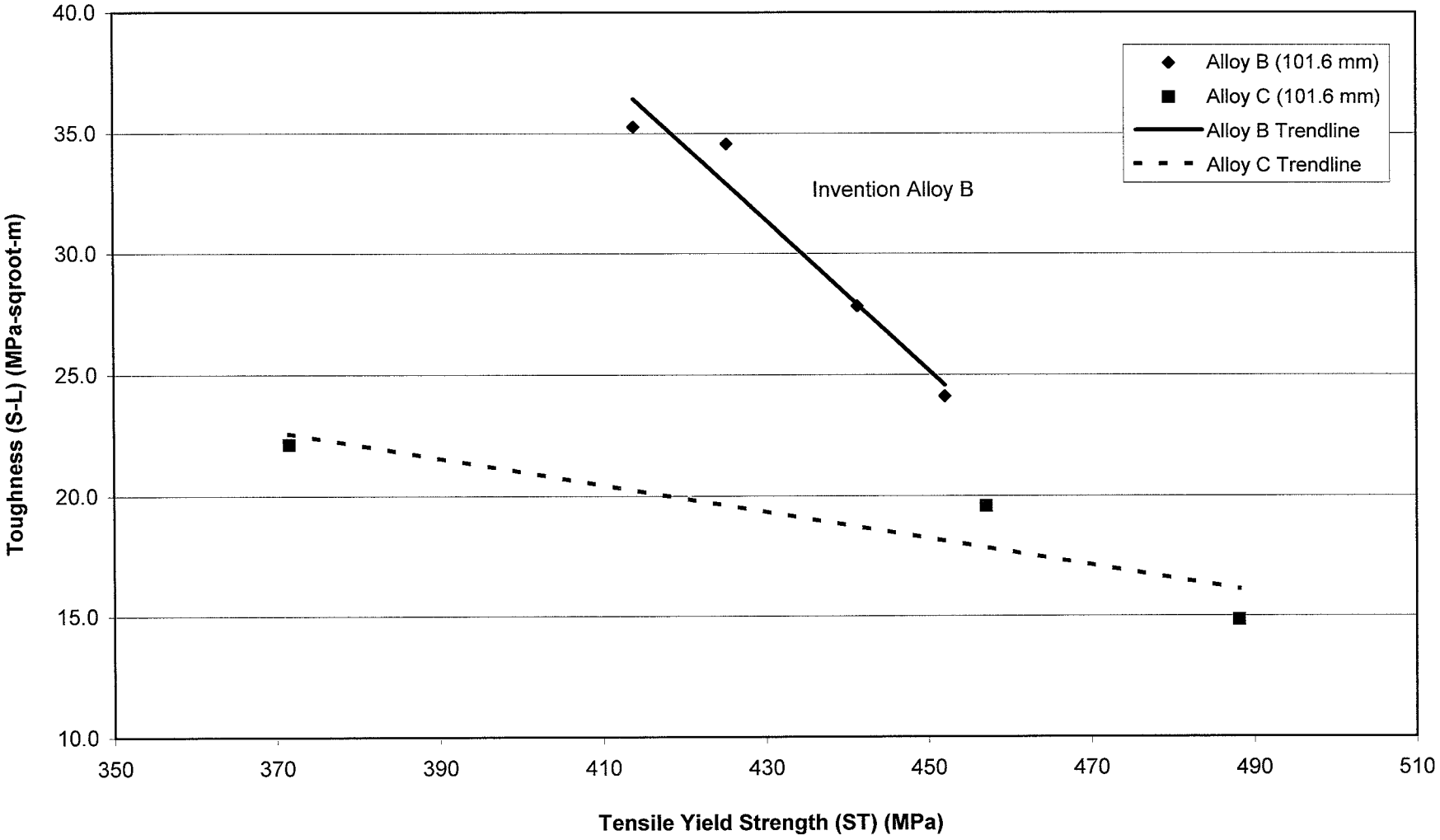

FIG. 5 - Long-Transverse Strength v. Toughness (63 mm products)
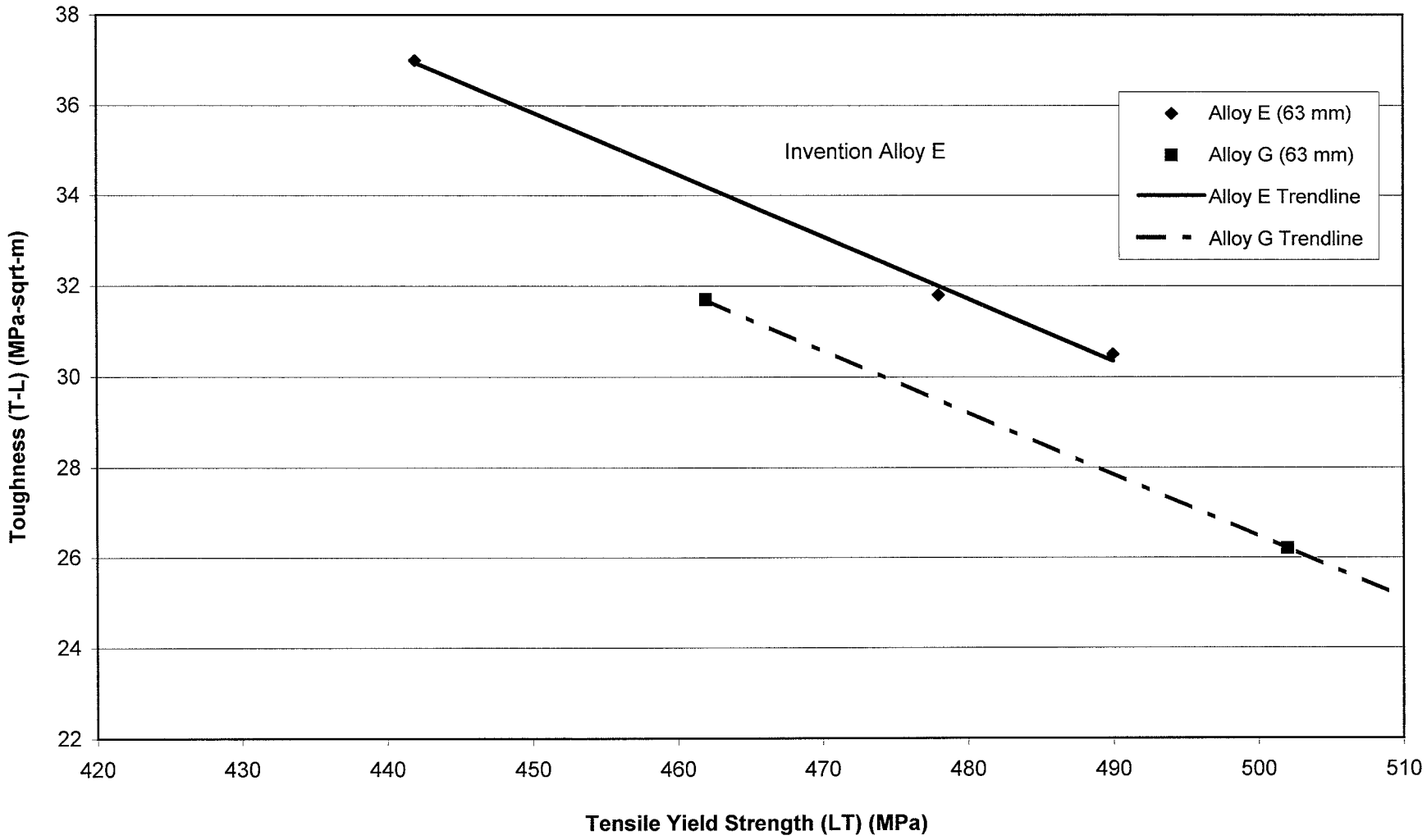

FIG. 6a - Short-Transverse Strength v. Toughness ( 63 mm products)
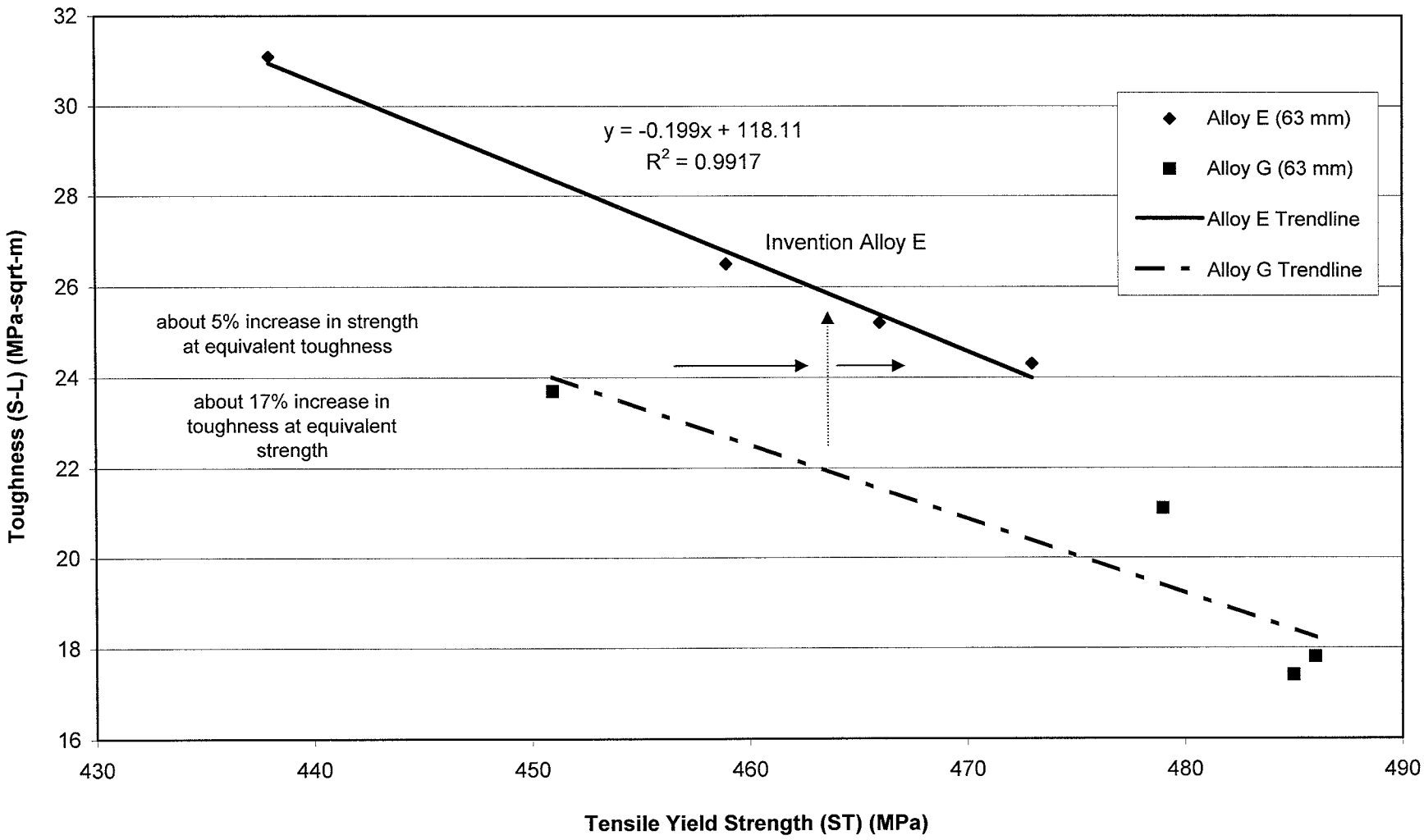

FIG. 6b - Short-Transverse Strength v. Toughness ( 50.8 - 76. 2 mm products)
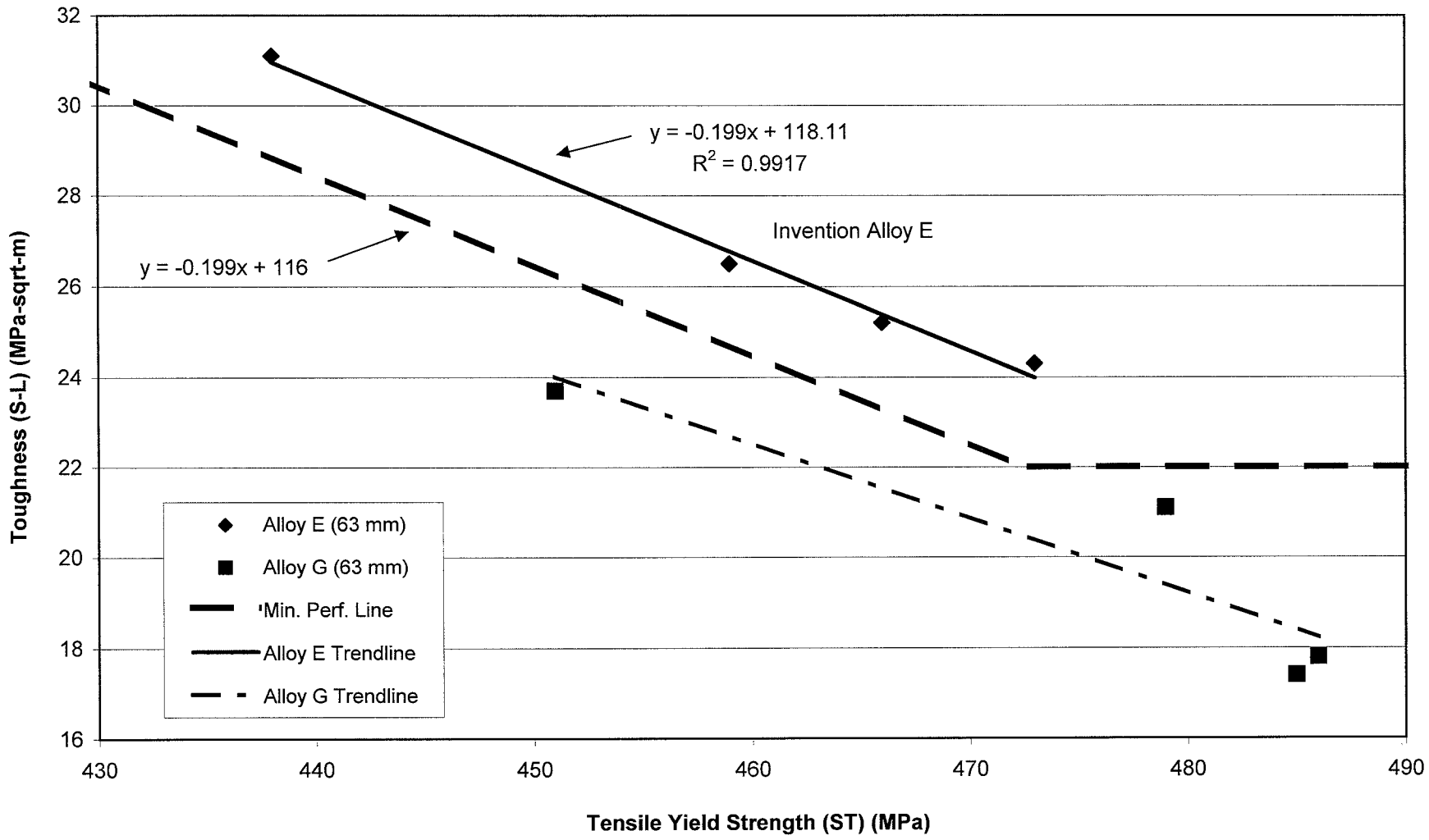

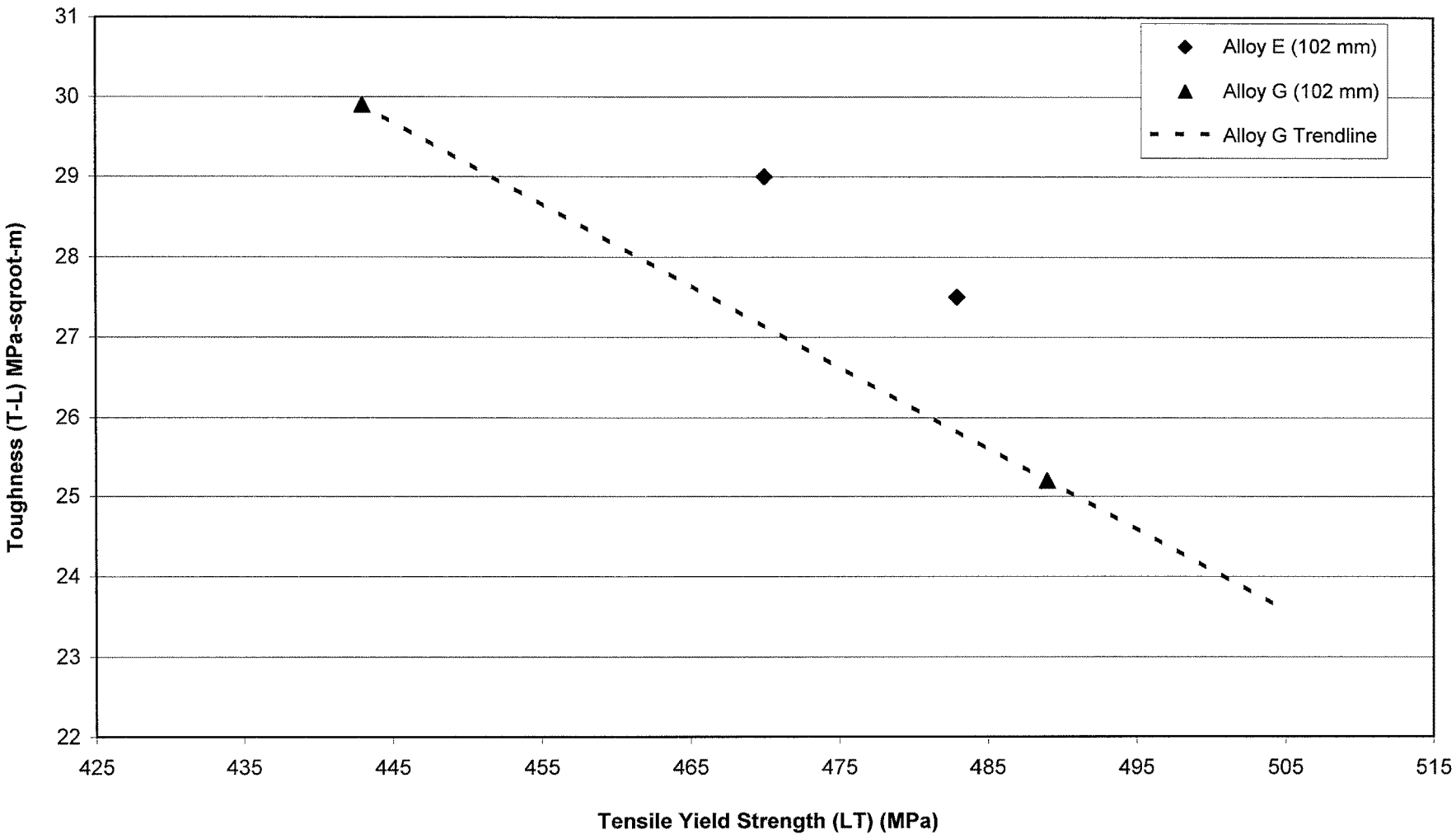
FIG. 7 - Long-Transverse Strength v. Toughness (102 mm products)

FIG. 8 - Short-Transverse Strength v. Toughness (102 mm products)
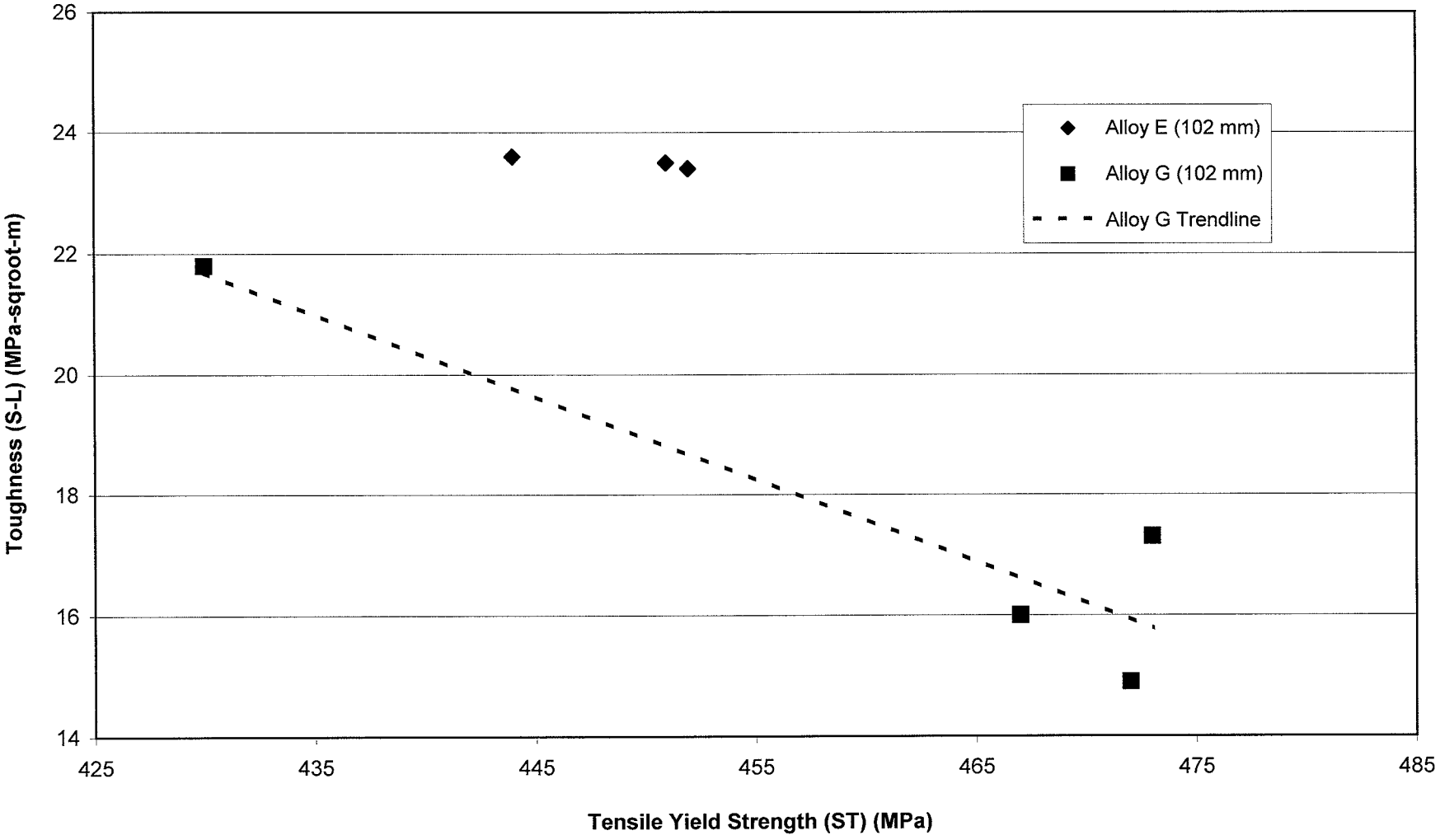

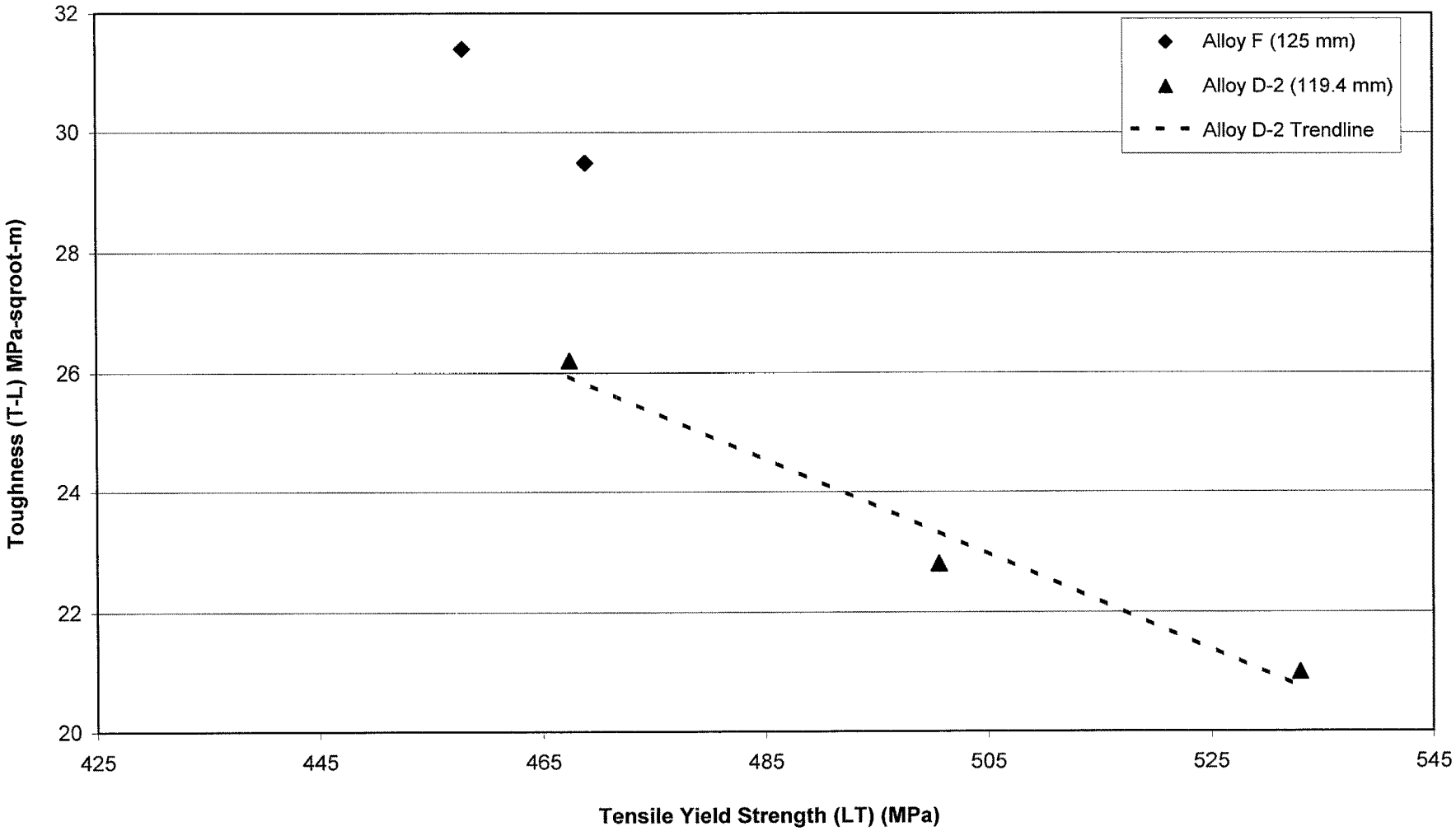
FIG. 9 - Long-Transverse Strength v. Toughness (119-125 mm products)

FIG. 10 - Short-Transverse Strength v. Toughness (119-125 mm products)
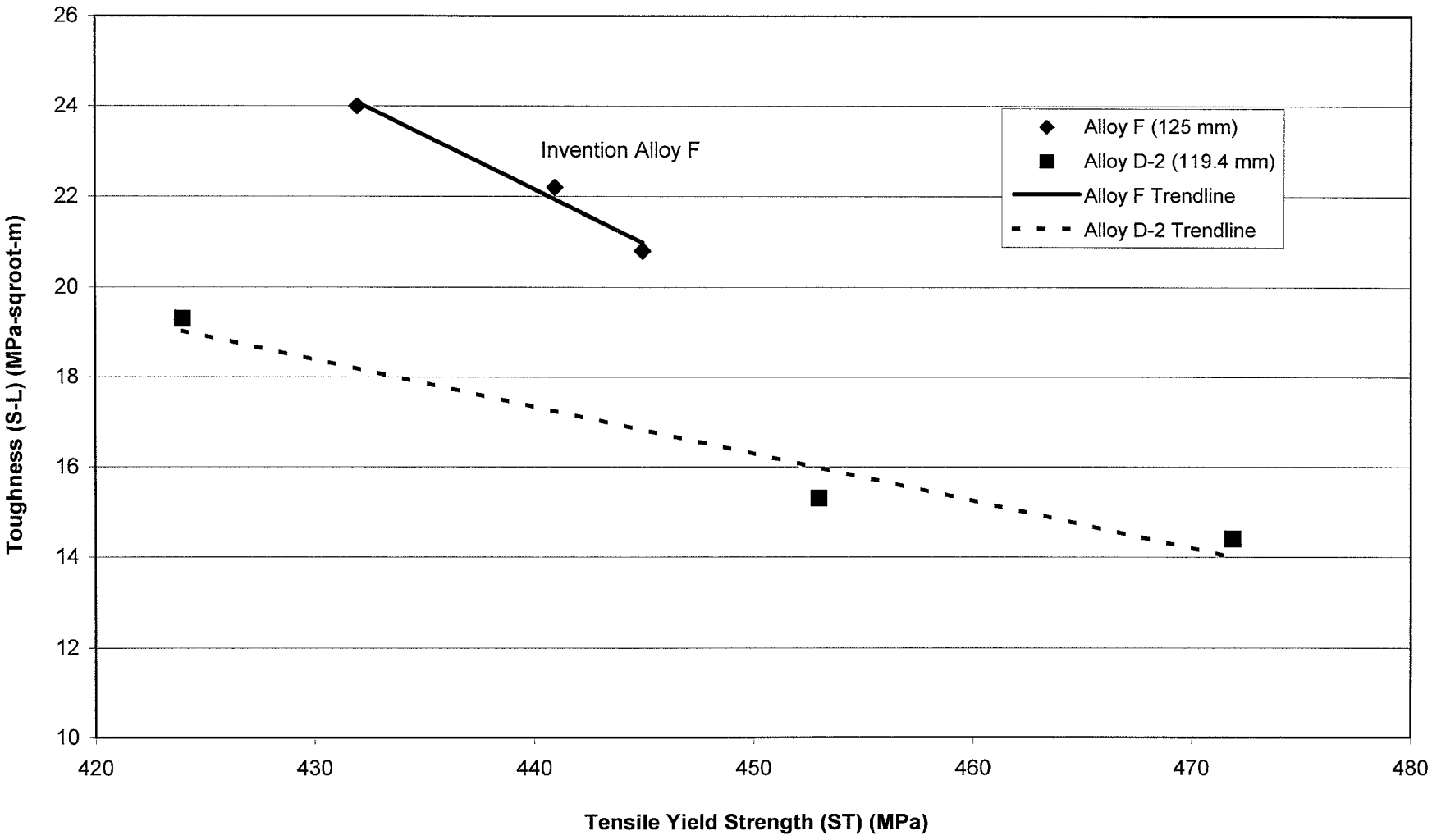

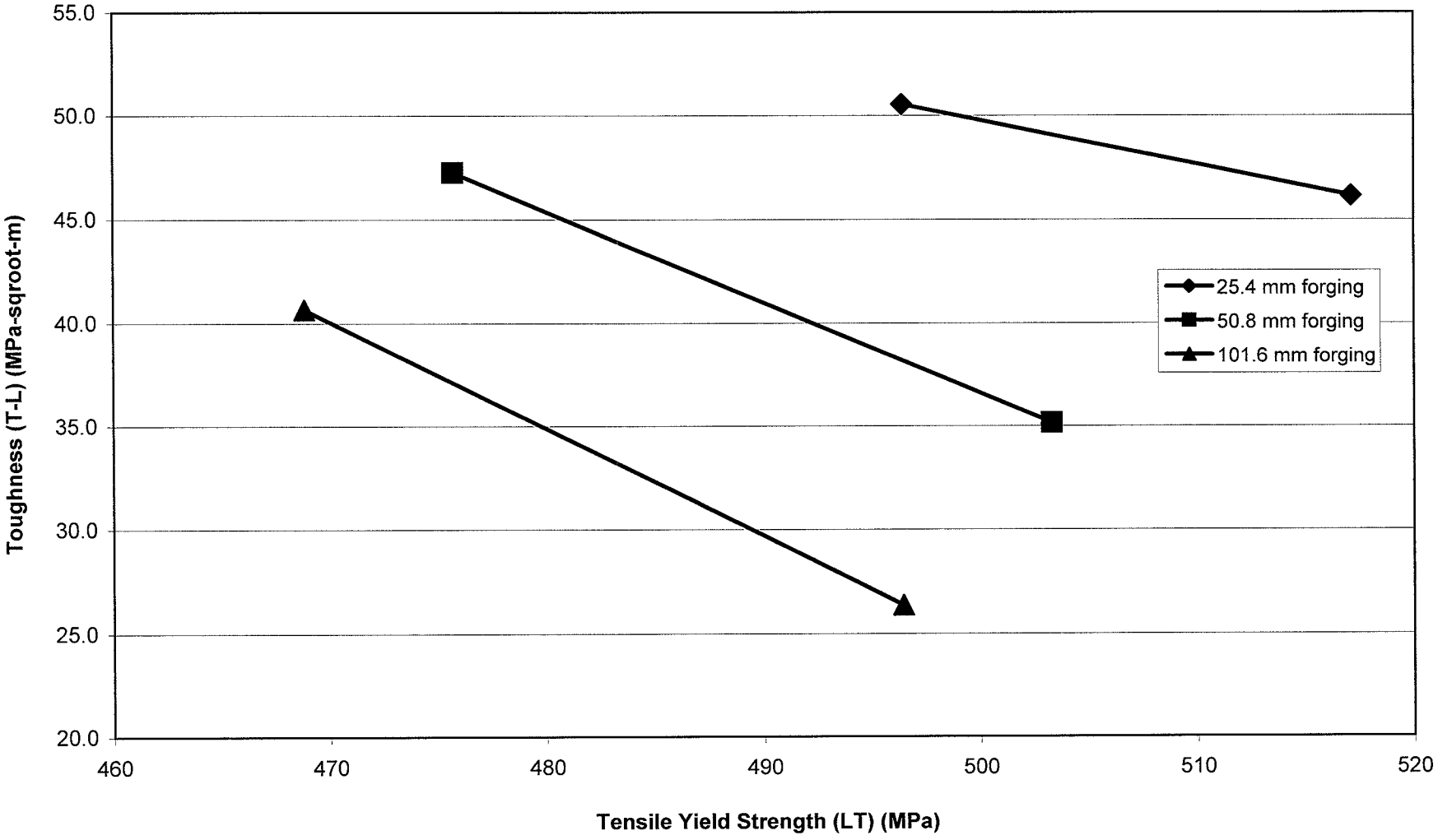
FIG. 11 - Long-Transverse Forging Data (various thicknesses)

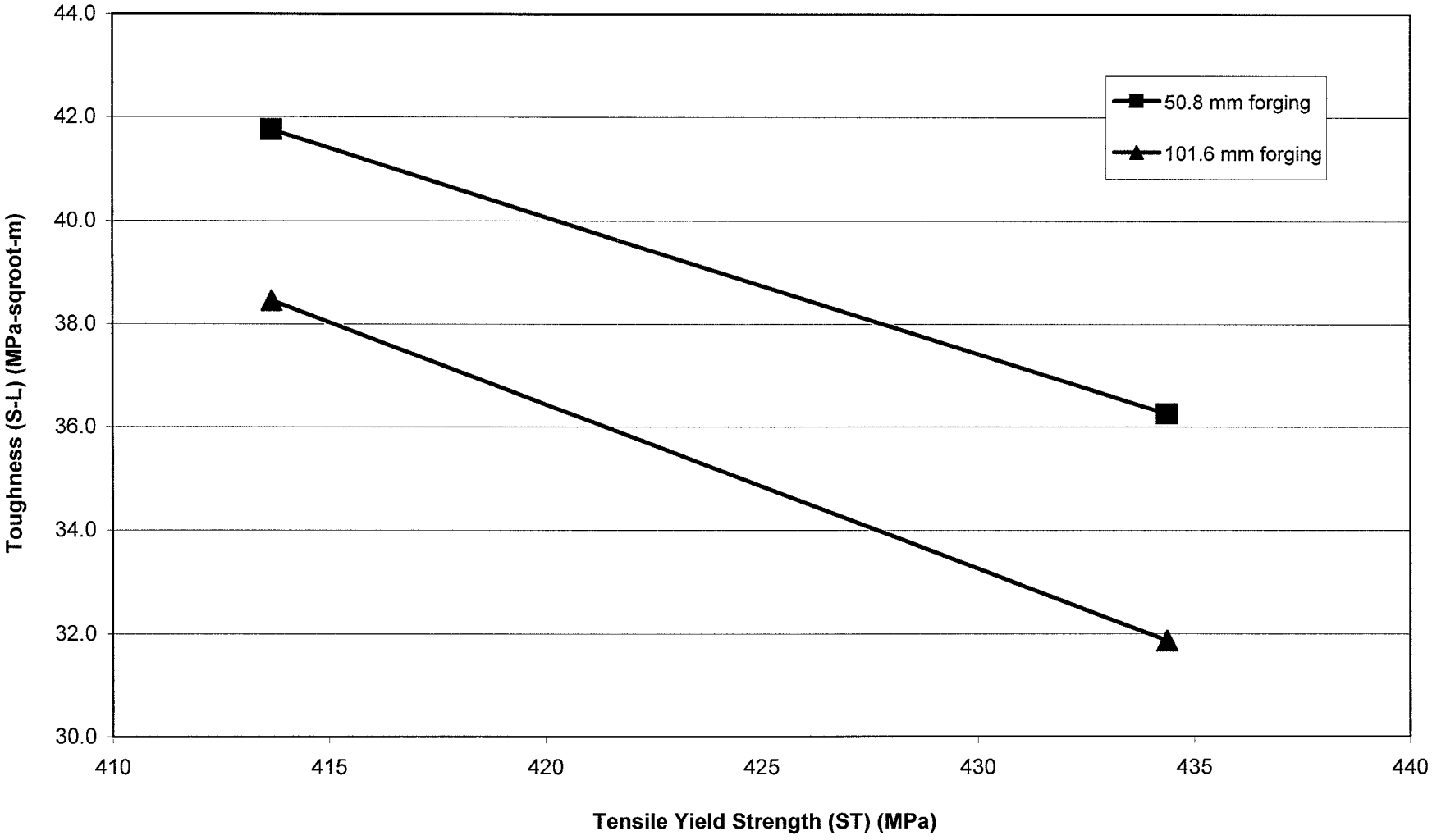
FIG. 12 - Short-Transverse Forging Data (various thicknesses)

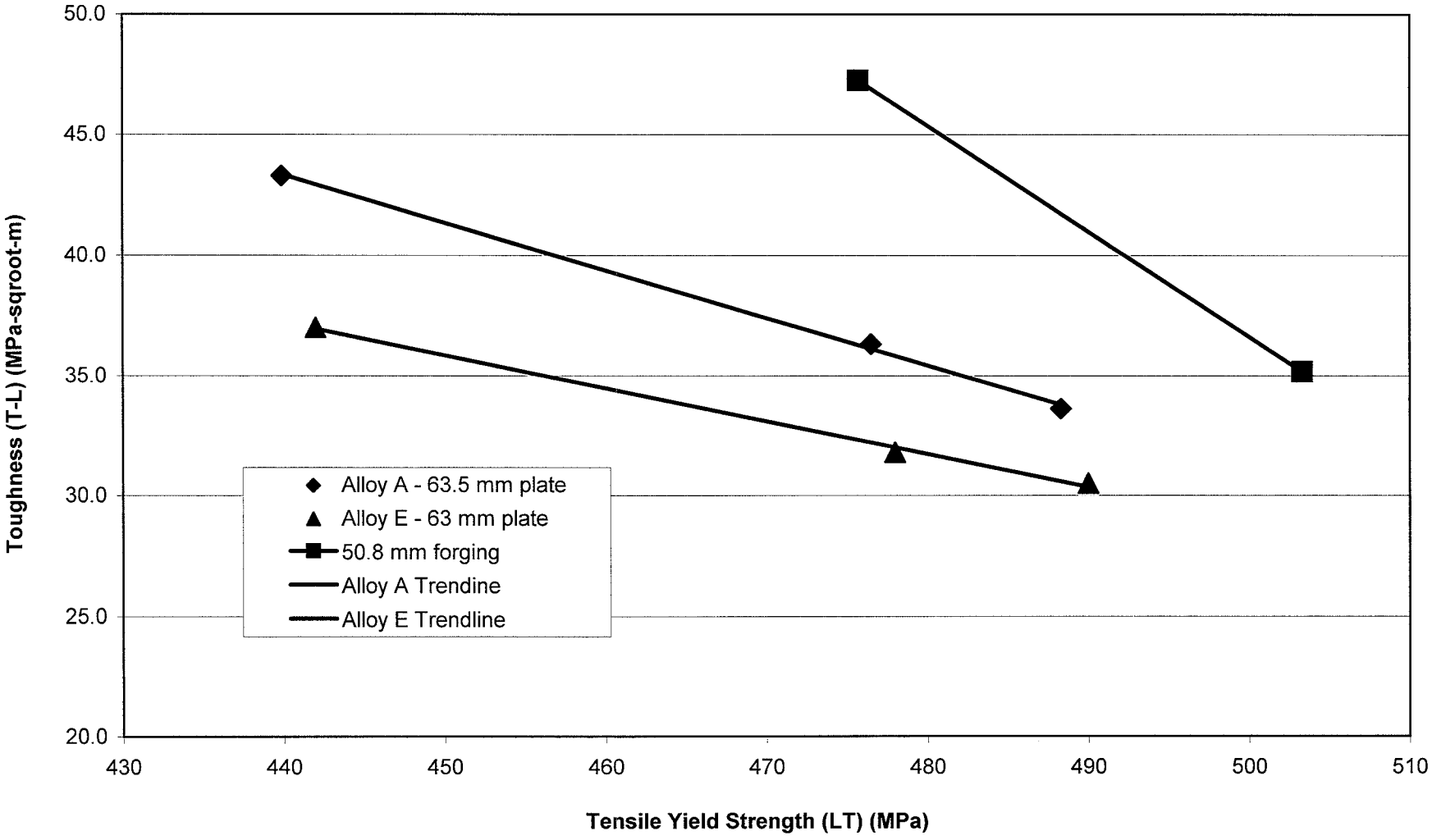
FIG. 13a - Long-Transverse Data (various invention alloys)

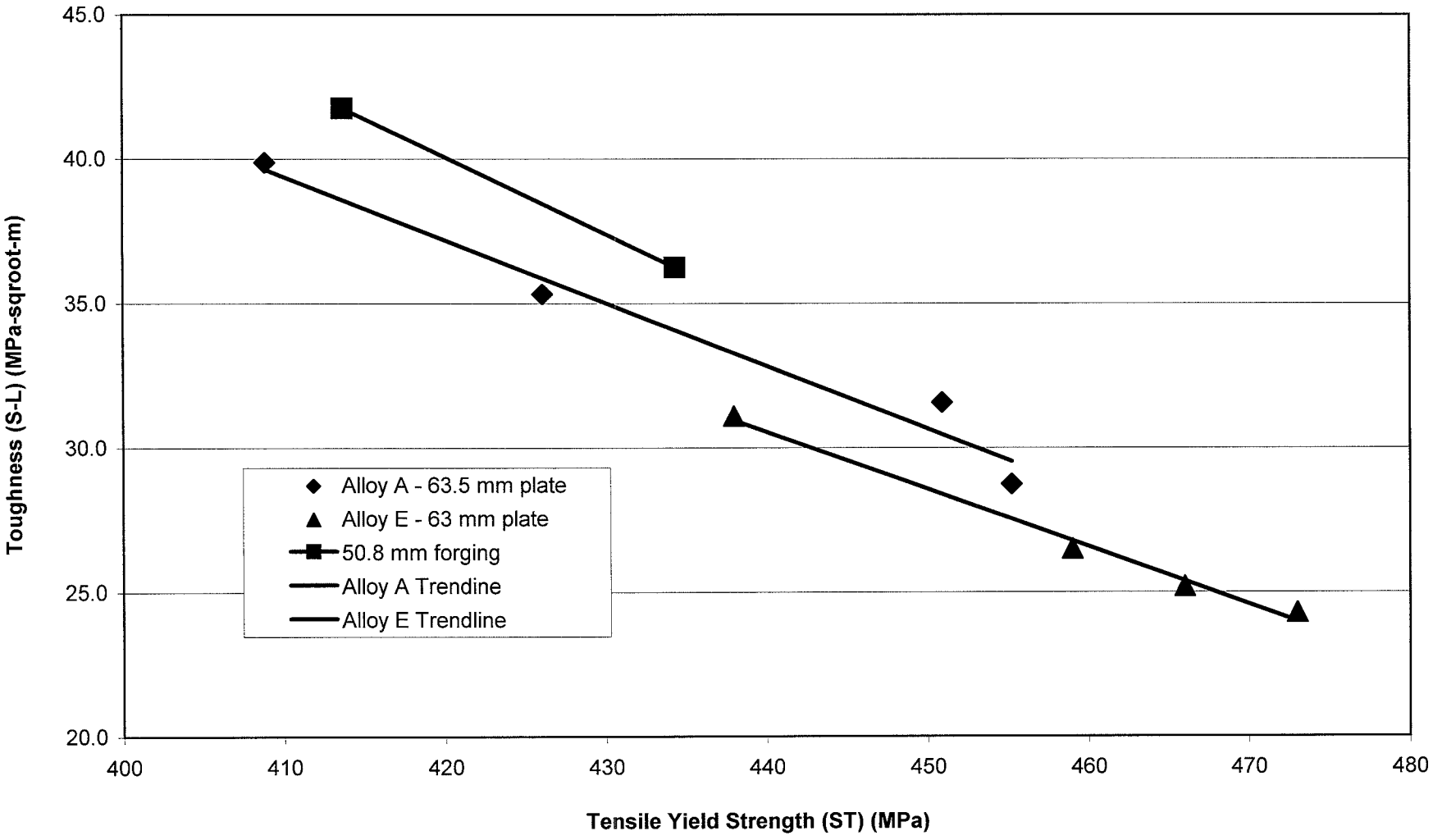
FIG. 13b - Short-Transverse Data (various invention alloys)

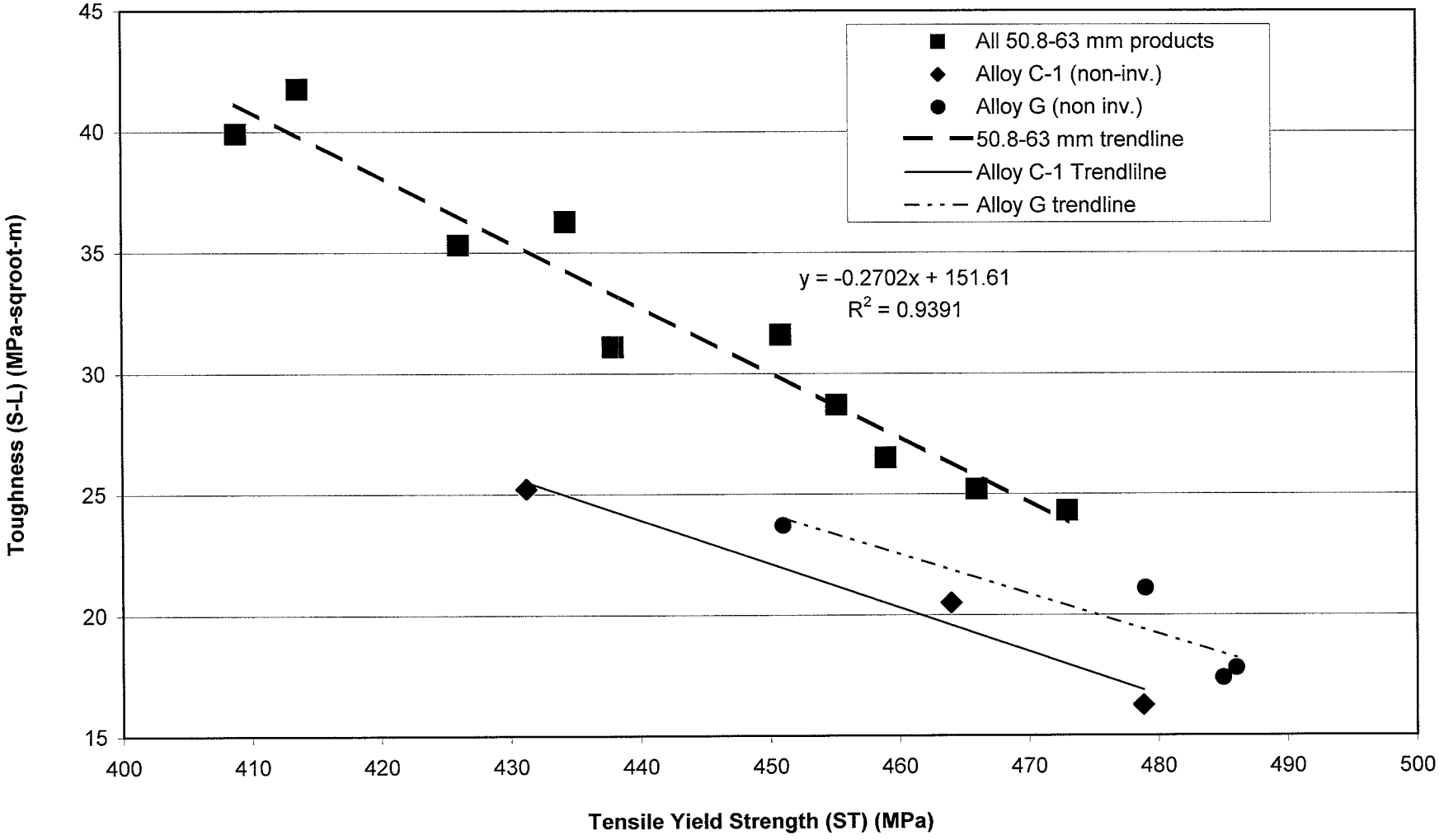
FIG. 13c - Short-Transverse Data - Trendlines - 50.8 - 76.2 mm

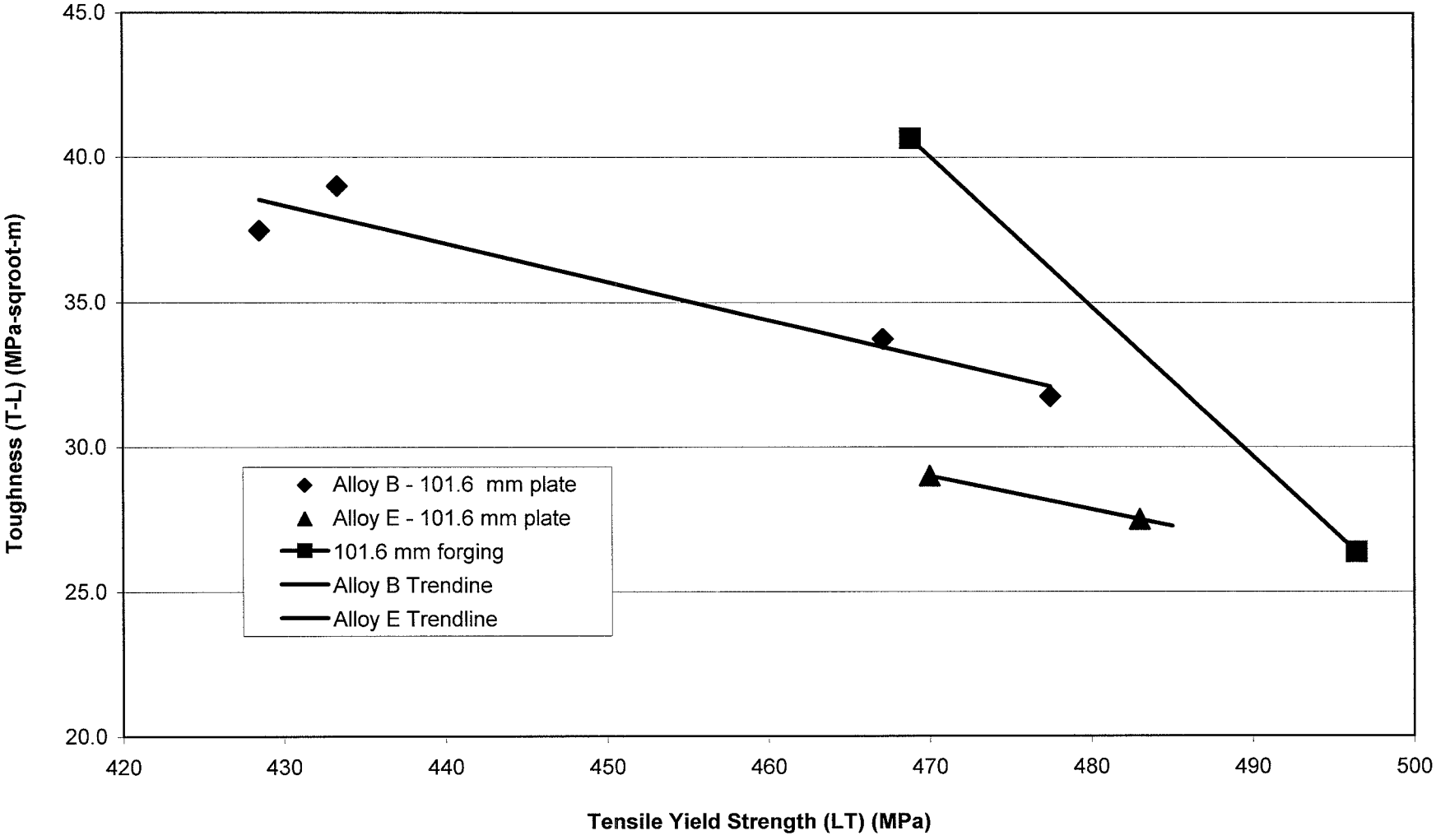
FIG. 14a - Long-Transverse Data (various invention alloys @ 101.6 mm)

FIG. 14b - Short-Transverse Data (various invention alloys @ 101.6 mm)
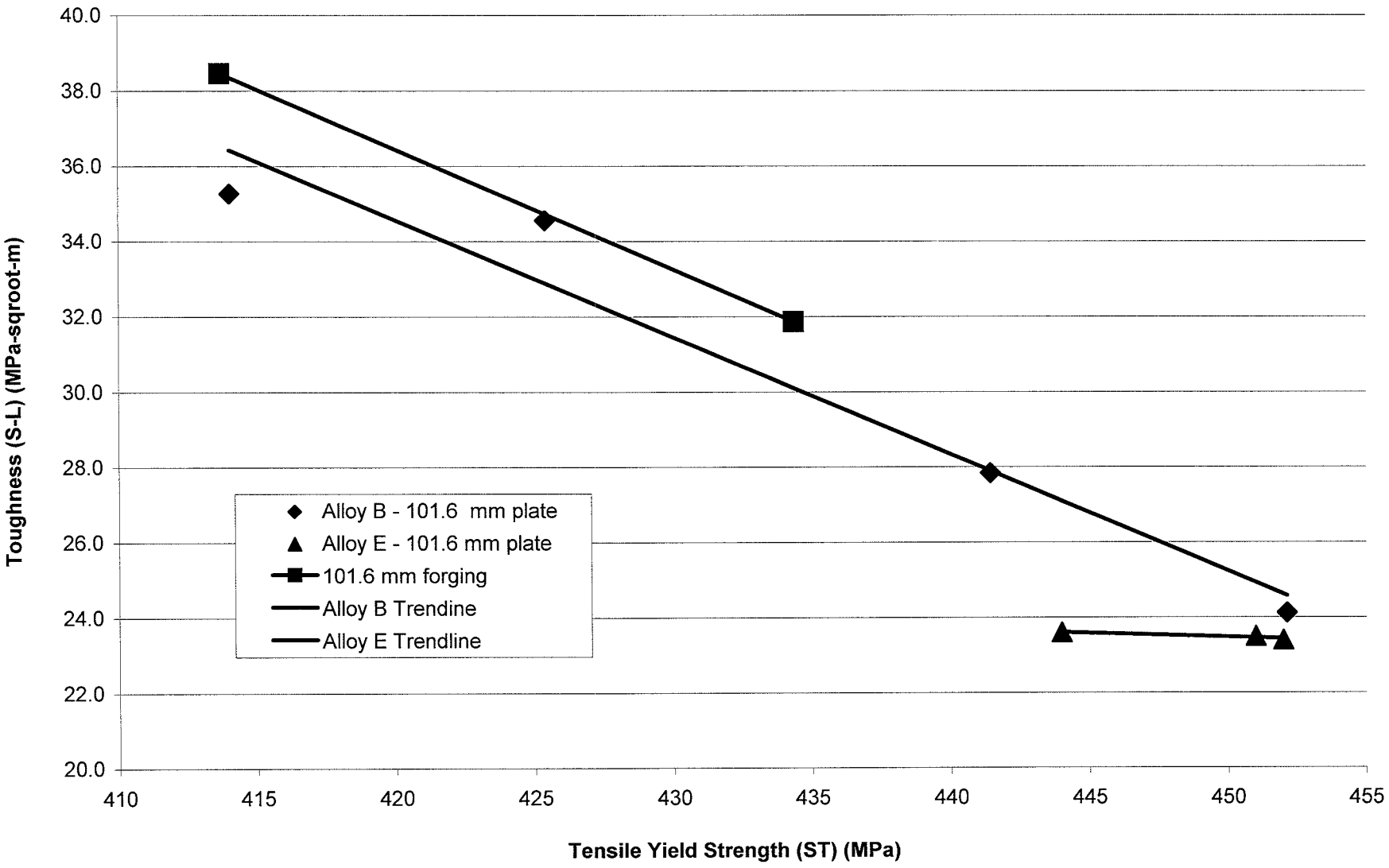

FIG. 14c - Short-Transverse Data - Trendlines (101.6 mm products)
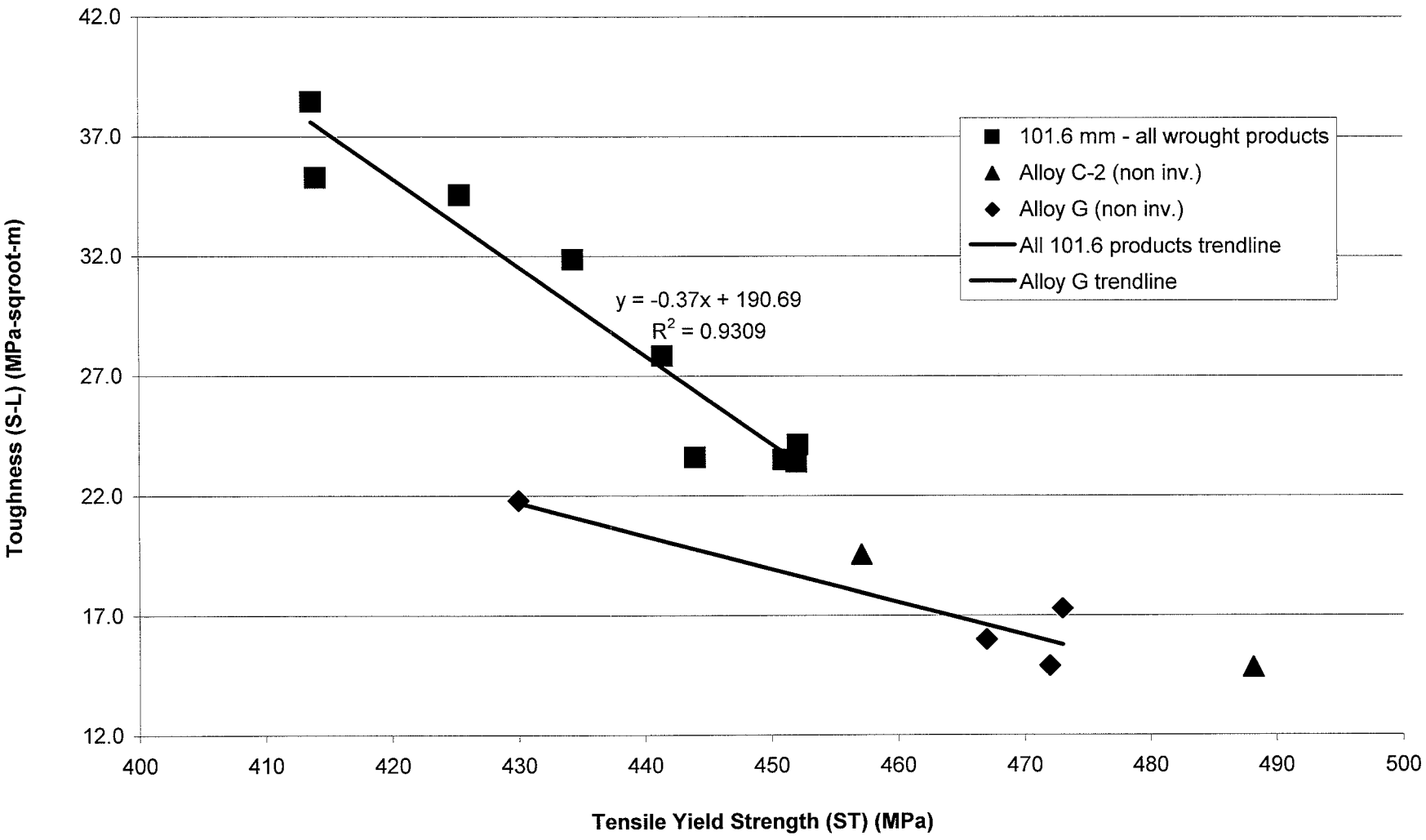

FIG 15a - Composition Diagram - Cu v. Li
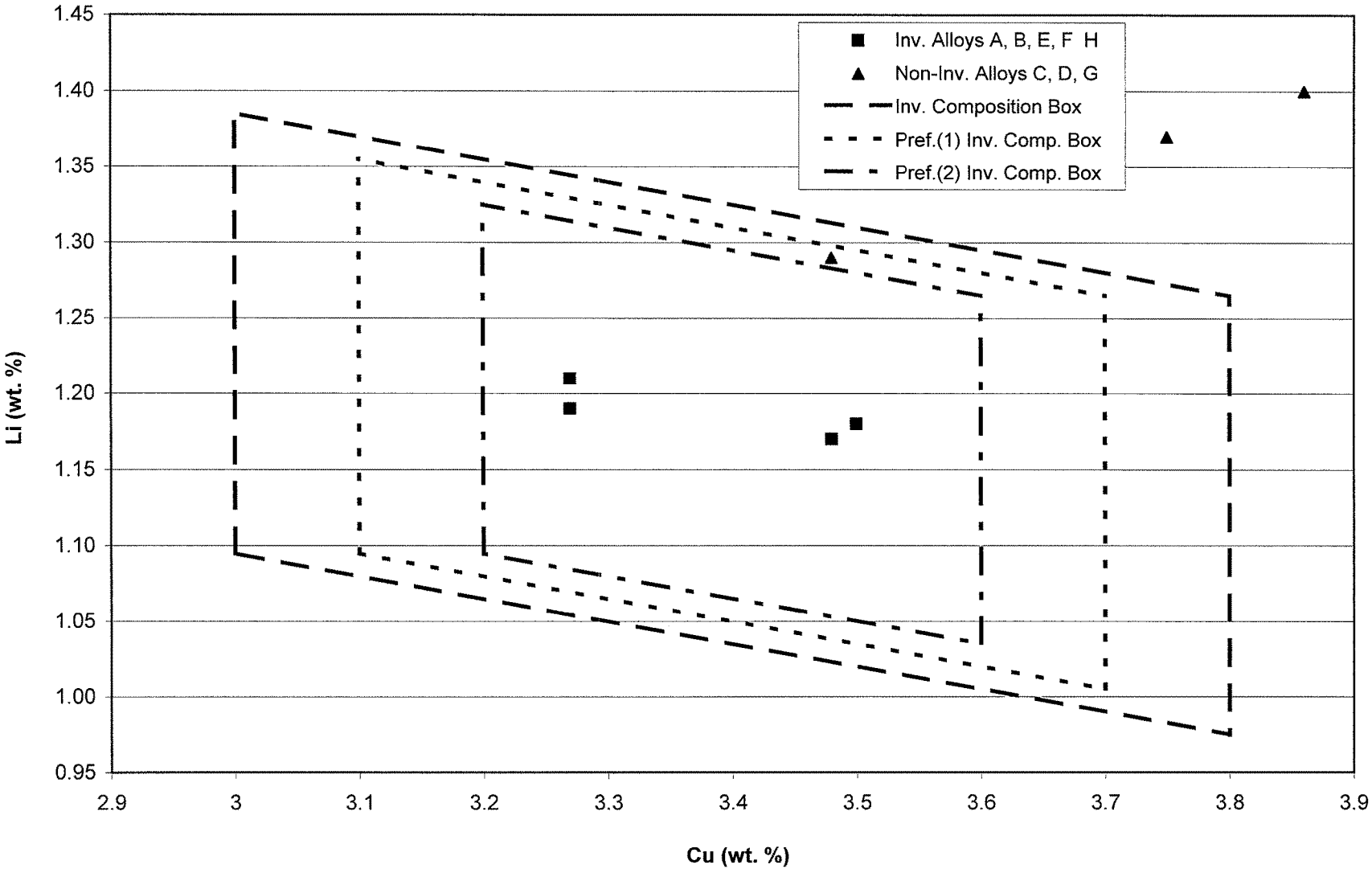

FIG 15b - Composition Diagram - Mg v. Li
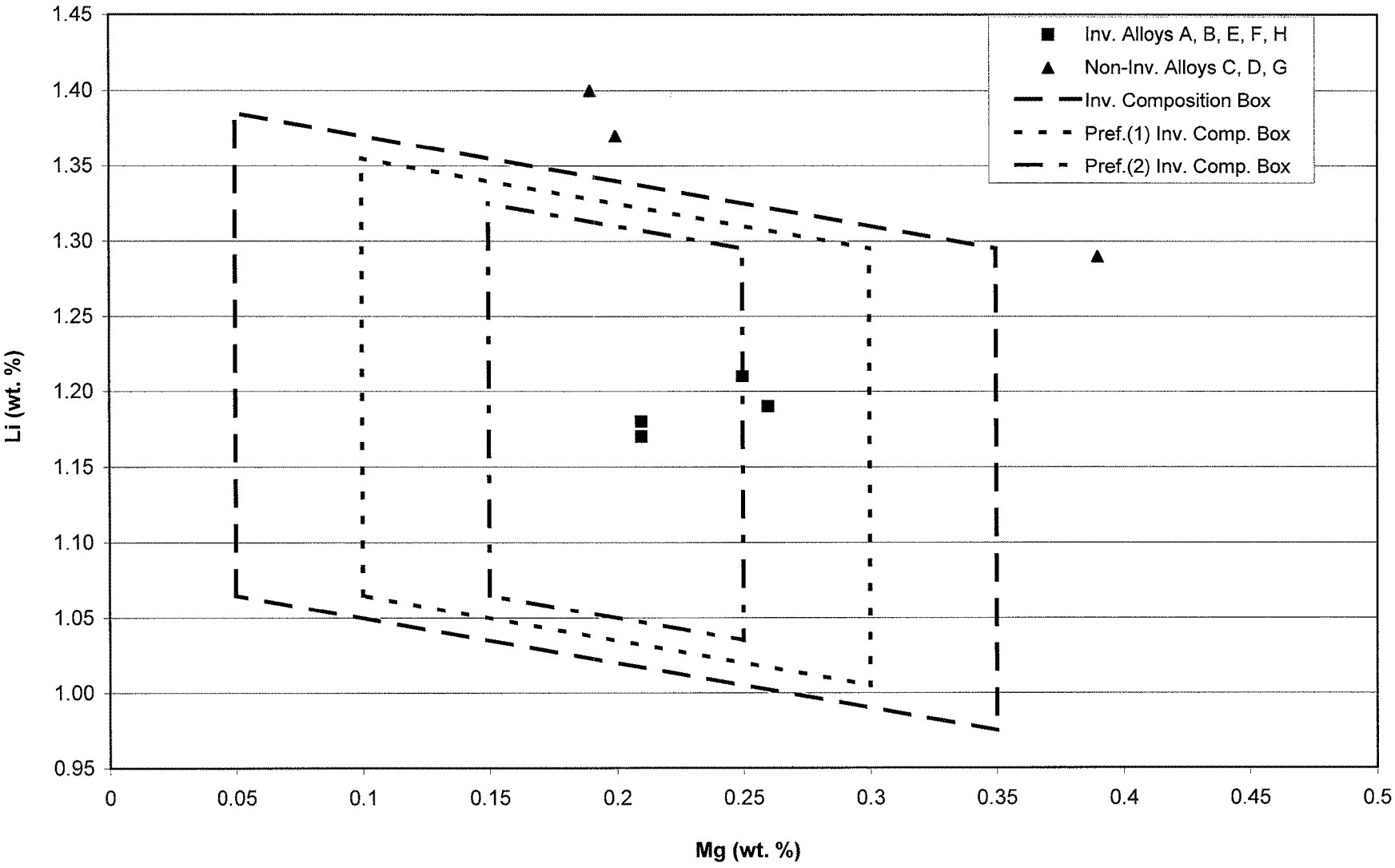

FIG 15c - Composition Diagram - Cu v. Mg
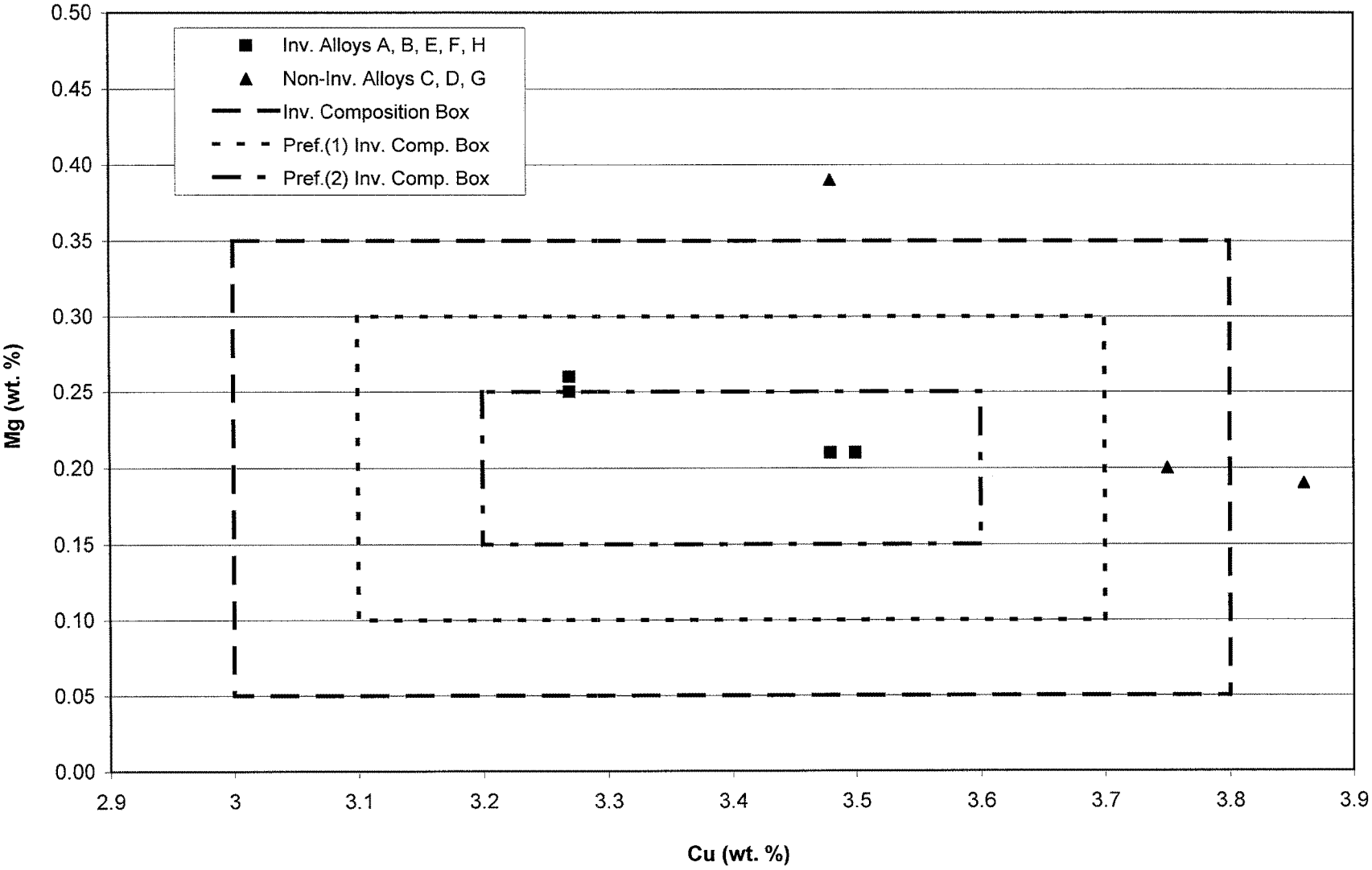

2XXX SERIES ALUMINUM LITHIUM ALLOYS

CROSS REFERENCE TO RELATED APPLICATION

This patent application claims priority to U.S. Provisional Patent Application No. 61/444,093, entitled "2XXX SERIES ALUMINUM LITHIUM ALLOYS", filed Feb. 17, 2011, and which is incorporated herein by reference in its entirety.

BACKGROUND

Aluminum alloys are useful in a variety of applications. However, improving one property of an aluminum alloy without degrading another property often proves elusive. For example, it is difficult to increase the strength of an alloy without decreasing the toughness of an alloy. Other properties of interest for aluminum alloys include corrosion resistance and fatigue crack growth rate resistance, to name two.

SUMMARY OF THE INVENTION

Broadly, the present patent application relates to thick wrought 2xxx aluminum lithium alloy products having improved properties. Generally, the thick wrought 2xxx aluminum lithium alloy products have 3.0 to 3.8 wt. % Cu, 0.05 to 0.35 wt. % Mg, 0.975 to 1.385 wt. % Li, where $-0.3*Mg-0.15Cu+1.65 \leq Li \leq -0.3*Mg-0.15Cu+1.85$, 0.05 to 0.50 wt. % of a grain structure control element selected from the group consisting of Zr, Sc, Cr, V, Hf, other rare earth elements, and combinations thereof, up to 1.0 wt. % Zn, up to 1.0 wt. % Mn, up to 0.15 wt. % Ti, up to 0.12 wt. % Si, up to 0.15 wt. % Fe, up to 0.10 wt. % of any other element, with the total of these other elements not exceeding 0.35 wt. %, the balance being aluminum. Thick wrought products incorporating such alloy compositions achieve an improved combination of strength and toughness. Composition limits of several alloys useful in accordance with the present teachings are disclosed in Tables 1a-1c, below (values in weight percent).

TABLE 1a

EXAMPLE COMPOSITION OF ALLOYS

| Alloy | Cu | Mg | Li | Cu—Mg—Li Relationship |
|---|---|---|---|---|
| Broad | 3.0-3.8 | 0.05-0.35 | 0.975-1.385 | $-0.3*Mg - 0.15Cu +$ |
| Pref. (1) | 3.1-3.7 | 0.10-0.30 | 1.005-1.355 | $1.65 \leq Li \leq$ |
| Pref. (2) | 3.2-3.6 | 0.15-0.25 | 1.035-1.325 | $-0.3*Mg - 0.15Cu + 1.85$ |
| Pref. (3) | 3.3-3.6 | 0.15-0.25 | 1.035-1.310 | |

TABLE 1b

EXAMPLE COMPOSITION OF ALLOYS

| Alloy | Mn | Grain Structure Control | Ti | Zn |
|---|---|---|---|---|
| Broad | 0-1.0 | 0.05-0.50 | 0-0.15 | 0-1.0 |
| Pref. (1) | 0.10-0.80 | 0.05-0.20 Zr | 0-0.10 | 0-1.0 |
| Pref. (2) | 0.20-0.60 | 0.07-0.14 Zr | 0.01-0.06 | 0-1.0 |
| Pref. (3) | 0.20-0.40 | 0.08-0.13 Zr | 0.01-0.03 | 0-1.0 |

TABLE 1c

EXAMPLE COMPOSITION OF ALLOYS

| Alloy | Fe | Si | Ag | Other Elements Each/Total | Balance |
|---|---|---|---|---|---|
| Broad | ≤0.15 | ≤0.12 | Include in "Other Elements" | 0.10/0.35 | Al |
| Pref. (1) | ≤0.12 | ≤0.10 | Include in "Other Elements" | 0.05/0.15 | Al |
| Pref. (2) | ≤0.08 | ≤0.06 | Include in "Other Elements" | 0.05/0.15 | Al |
| Pref. (3) | ≤0.05 | ≤0.04 | Include in "Other Elements" | 0.03/0.10 | Al |

Thick wrought aluminum alloy products are those wrought products having a cross-sectional thickness of at least 12.7 mm. In one embodiment, a thick wrought aluminum alloy product has a thickness of at least 25.4 mm. In another embodiment, a thick wrought aluminum alloy product has a thickness of at least 50.8 mm. The improved properties described herein may be achieved with thick wrought products having a thickness of up to 177.8 mm, or up to 152.4 mm, or up to 127 mm, or up to 101.6 mm. As used in this paragraph, thickness refers to the minimum thickness of the product, realizing that some portions of the product may realize slightly larger thicknesses than the minimum stated.

Copper (Cu) is included in the new alloy, and generally in the range of from 3.0 wt. % to 3.8 wt. % Cu. In one embodiment, the new alloy includes at least 3.1 wt. % Cu. In other embodiments, the new alloy may include at least 3.2 wt. % Cu, or at least 3.3 wt. % Cu, or at least 3.35 wt. % Cu, or at least 3.4 wt. % Cu. In one embodiment, the new alloy includes not greater than 3.75 wt. % Cu. In other embodiments, the new alloy may include not greater than 3.7 wt. % Cu, or not greater than 3.65 wt. % Cu, or not greater than 3.6 wt. % Cu.

Magnesium (Mg) is included in the new alloy, and generally in the range of from 0.05 wt. % to 0.35 wt. % Mg. In one embodiment, the new alloy includes at least 0.10 wt. % Mg. In other embodiments, the new alloy may include at least 0.15 wt. % Mg. In one embodiment, the new alloy includes not greater than 0.35 wt. % Mg. In other embodiments, the new alloy may include not greater than 0.30 wt. % Mg, or not greater than 0.25 wt. % Mg.

Lithium (Li) is included in the new alloy, and generally in the range of from 0.975 wt. % to 1.385. In one embodiment, the new alloy includes at least 1.005 wt. % Li. In other embodiments, the new alloy may include at least 1.035 wt. % Li, or at least 1.050 wt. % Li, or at least, or at least 1.065 wt. % Li, or at least 1.080 wt. % Li, or at least 1.100 wt. % Li, or at least 1.125 wt. % Li, or at least 1.150 wt. %. In one embodiment, the new alloy includes not greater than 1.355 wt. % Li. In other embodiments, the new alloy includes not greater than 1.325 wt. % Li, or not greater than 1.310 wt. %, or not greater than 1.290 wt. % Li, or not greater than 1.270 wt. % Li, or not greater than 1.250 wt. % Li.

The combined amounts of Cu, Mg, and Li may be related to realization of improved properties. In one embodiment, the aluminum alloy includes Cu, Mg, and Li per the above requirements, and in accordance with the following expression:

$$-0.3*Mg-0.15Cu+1.65 \leq Li \leq -0.3*Mg-0.15Cu+1.85 \quad (1)$$

In other words:

$$Li_{min}=1.65-0.3(Mg)-0.15(Cu); \text{ and} \quad (2)$$

$$Li_{max}=1.85-0.3(Mg)-0.15(Cu) \quad (3)$$

Aluminum alloy products having an amount of Cu, Mg, and Li falling within the scope of these expressions may realize an improved combination of properties (e.g., an improved strength-toughness relationship).

Zinc (Zn) may optionally be included in the new alloy and up to 1.0 wt. % Zn. In one embodiment, the new alloy includes at least 0.20 wt. % Zn. In one embodiment, the new alloy includes at least 0.30 wt. % Zn. In one embodiment, the new alloy includes not greater than 0.50 wt. % Zn. In another embodiment, the new alloy includes not greater than 0.40 wt. % Zn.

Manganese (Mn) may optionally be included in the new alloy, and in an amount up to 1.0 wt. %. In one embodiment, the new alloy includes at least 0.05 wt. % Mn. In other embodiments, the new alloy includes at least 0.10 wt. % Mn, or at least 0.15 wt. % Mn, or at least 0.2 wt. % Mn. In one embodiment, the new alloy includes not greater than 0.8 wt. % Mn. In other embodiments, the new alloy includes not greater than 0.7 wt. % Mn, or not greater than 0.6 wt. % Mn, or not greater than 0.5 wt. % Mn, or not greater than 0.4 wt. % Mn. In the alloying industry, manganese may be considered both an alloying ingredient and a grain structure control element—the manganese retained in solid solution may enhance a mechanical property of the alloy (e.g., strength), while the manganese in particulate form (e.g., as $Al_6Mn$, $Al_{12}Mn_3Si_2$—sometimes referred to as dispersoids) may assist with grain structure control. However, since Mn is separately defined with its own composition limits in the present patent application, it is not within the definition of "grain structure control element" (described below) for the purposes of the present patent application.

The alloy may include 0.05 to 0.50 wt. % of at least one grain structure control element selected from the group consisting of zirconium (Zr), scandium (Sc), chromium (Cr), vanadium (V) and/or hafnium (Hf), and/or other rare earth elements, and such that the utilized grain structure control element(s) is/are maintained below maximum solubility. As used herein, "grain structure control element" means elements or compounds that are deliberate alloying additions with the goal of forming second phase particles, usually in the solid state, to control solid state grain structure changes during thermal processes, such as recovery and recrystallization. For purposes of the present patent application, grain structure control elements include Zr, Sc, Cr, V, Hf, and other rare earth elements, to name a few, but excludes Mn.

The amount of grain structure control material utilized in an alloy is generally dependent on the type of material utilized for grain structure control and/or the alloy production process. In one embodiment, the grain structure control element is Zr, and the alloy includes from 0.05 wt. % to 0.20 wt. % Zr. In another embodiment, the alloy includes from 0.05 wt. % to 0.15 wt. % Zr. In another embodiment, the alloy includes 0.07 to 0.14 wt. % Zr. In another embodiment, the alloy includes 0.08-0.13 wt. % Zr. In one embodiment, the aluminum alloy includes at least 0.07 wt. % Zr. In another embodiment, the aluminum alloy includes at least 0.08 wt. % Zr. In one embodiment, the aluminum alloy includes not greater than 0.18 wt. % Zr. In another embodiment, the aluminum alloy includes not greater than 0.15 wt. % Zr. In another embodiment, the aluminum alloy includes not greater than 0.14 wt. % Zr. In another embodiment, the aluminum alloy includes not greater than 0.13 wt. % Zr.

The alloy may include up to 0.15 wt. % Ti cumulatively for grain refining and/or other purposes. Grain refiners are inoculants or nuclei to seed new grains during solidification of the alloy. An example of a grain refiner is a 9.525 mm rod comprising 96% aluminum, 3% titanium (Ti) and 1% boron (B), where virtually all boron is present as finely dispersed $TiB_2$ particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., $TiB_2$) or carbon (TiC), although other grain refiners, such as Al—Ti master alloys may be utilized. Generally, grain refiners are added in an amount ranging from 0.0003 wt. % to 0.005 wt. % to the alloy, depending on the desired as-cast grain size. In addition, Ti may be separately added to the alloy in an amount up to 0.15 wt. %, depending on product form, to increase the effectiveness of grain refiner, and typically in the range of 0.01 to 0.03 wt. % Ti. When Ti is included in the alloy, it is generally present in an amount of from 0.01 to 0.10 wt. %. In one embodiment, the aluminum alloy includes a grain refiner, and the grain refiner is at least one of $TiB_2$ and TiC, where the wt. % of Ti in the alloy is from 0.01 to 0.06 wt. %, or from 0.01 to 0.03 wt. %.

The aluminum alloy may include iron (Fe) and silicon (Si), typically as impurities. The iron content of the new alloy should generally not exceed 0.15 wt. %. In one embodiment, the iron content of the alloy is not greater than 0.12 wt. %. In other embodiments, the aluminum alloy includes not greater than 0.10 wt. % Fe, or not greater than 0.08 wt. % Fe, or not greater than 0.05 wt. % Fe, or not greater than 0.04 wt. % Fe. Similarly, the silicon content of the new alloy should generally not exceed 0.12 wt. %. In one embodiment, the silicon content of the alloy is not greater than 0.10 wt. % Si, or not greater than 0.08 wt. % Si, or not greater than 0.06 wt. % Si, or not greater than 0.04 wt. % Si, or not greater than 0.03 wt. % Si.

In some embodiments of the present patent application, silver (Ag) is considered an impurity, and, in these embodiments, is included in the definition of "other elements", defined below, i.e., is at an impurity level of 0.10 wt. % or less, depending on which "other element" limits are applied to the alloy. In other embodiments, silver is purposefully included in the alloy (e.g., for strength) and in an amount of from 0.11 wt. % to 0.50 wt. %.

The new 2xxx aluminum lithium alloys generally contain low amounts of "other elements" (e.g., casting aids and impurities, other than the iron and silicon). As used herein, "other elements" means any other element of the periodic table except for aluminum and the above-described copper, magnesium, lithium, zinc, manganese, grain structure control elements (i.e., Zr, Sc, Cr, V Hf, and other rare earth elements), iron and/or silicon, as applicable, described above. In one embodiment, the new 2xxx aluminum lithium alloys contain not more than 0.10 wt. % each of any other element, with the total combined amount of these other elements not exceeding 0.35 wt. %. In another embodiment, each one of these other elements, individually, does not exceed 0.05 wt. % in the 2xxx aluminum lithium alloy, and the total combined amount of these other elements does not exceed 0.15 wt. % in the 2xxx aluminum lithium alloy. In another embodiment, each one of these other elements, individually, does not exceed 0.03 wt. % in the 2xxx aluminum lithium alloy, and the total combined amount of these other elements does not exceed 0.10 wt. % in the 2xxx aluminum lithium alloy.

The new alloys may be used in all wrought product forms, including plate, forgings and extrusions.

The new alloy can be prepared into wrought form, and in the appropriate temper, by more or less conventional practices, including direct chill (DC) casting the aluminum alloy into ingot form. After conventional scalping, lathing or peeling (if needed) and homogenization, which homogenization may be completed before or after scalping, these ingots may be further processed by hot working the product. The product may then be optionally cold worked, optionally annealed, solution heat treated, quenched, and final cold worked. After the final cold working step, the product may be artificially aged. Thus, the products may be produced in a T3 or T8 temper.

Unless otherwise indicated, the following definitions apply to the present application:

"Wrought aluminum alloy product" means an aluminum alloy product that is hot worked after casting, and includes rolled products (plate), forged products, and extruded products.

"Forged aluminum alloy product" means a wrought aluminum alloy product that is either die forged or hand forged.

"Solution heat treating" means exposure of an aluminum alloy to elevated temperature for the purpose of placing solute(s) into solid solution.

"Hot working" means working the aluminum alloy product at elevated temperature, generally at least 250° F.

"Cold working" means working the aluminum alloy product at temperatures that are not considered hot working temperatures, generally below about 250° F.

"Artificially aging" means exposure of an aluminum alloy to elevated temperature for the purpose of precipitating solute(s). Artificial aging may occur in one or a plurality of steps, which can include varying temperatures and/or exposure times.

These and other aspects, advantages, and novel features of this new technology are set forth in part in the description that follows and will become apparent to those skilled in the art upon examination of the following description and figures, or may be learned by practicing one or more embodiments of the technology provided for by the present disclosure.

BRIEF DESCRIPTION OF THE DRAWINGS

FIGS. 1-4 are graphs illustrating the performance of various aluminum alloy products of Example 1.

FIGS. 5-6*a* and 7-8 are graphs illustrating the performance of various aluminum alloy products of Example 2.

FIG. 6*b* is a graph providing an example of a minimum performance line for 50.8-76.2 mm products made from the aluminum alloys of the present invention.

FIGS. 9-10 are graphs illustrating the performance of various aluminum alloy products of Examples 1-2.

FIGS. 11-12 are graphs illustrating the performance of various aluminum alloy products of Example 3.

FIGS. 13*a*-13*c* are graphs illustrating the performance of various aluminum alloy products of Examples 1-3.

FIGS. 14*a*-14*c* are graphs illustrating the performance of various aluminum alloy products of Examples 1-3.

FIGS. 15*a*-15*c* are graphs illustrating various composition for the aluminum alloys useful in accordance with the present invention.

DETAILED DESCRIPTION

Example 1

Plate Testing

Various Al—Li alloys are cast as rectangular ingot and homogenized. The scalped ingots had a thickness of 368.3 mm. The composition of each ingot is shown in Table 2a, below. Alloys A-B are invention alloys, while Alloys C-D are non-invention alloys.

TABLE 2a

COMPOSITION OF ALLOYS

| Alloy | Si | Fe | Cu | Mg | Mn | Zn | Ti | Zr | Li |
|---|---|---|---|---|---|---|---|---|---|
| A | 0.018 | 0.027 | 3.50 | 0.21 | 0.30 | 0.35 | 0.019 | 0.130 | 1.18 |
| B | 0.015 | 0.027 | 3.48 | 0.21 | 0.29 | 0.34 | 0.017 | 0.127 | 1.17 |
| C | 0.02 | 0.03 | 3.86 | 0.19 | 0.35 | 0.46 | 0.02 | 0.11 | 1.40 |
| D | 0.02 | 0.03 | 3.75 | 0.20 | 0.35 | 0.46 | 0.02 | 0.11 | 1.37 |

The balance of each alloy is aluminum and other elements, with no one other element exceeding 0.05 wt. %, and with the total of these other elements not exceeding 0.15 wt. %. The alloys are hot rolled, solution heat treated, quenched and stretched about 6%. Alloys C and D are rolled to two different gauges. The approximate final gauges are provided in Table 2b, below.

TABLE 2b

ALLOYS AND FINAL GAUGE

| Alloy | Final Gauge (mm) | Final Gauge (in.) |
|---|---|---|
| A | 63.5 | 2.5 |
| B | 101.6 | 4.0 |
| C-1 | 68.6 | 2.7 |
| C-2 | 101.6 | 4.0 |
| D-1 | 76.2 | 3.0 |
| D-2 | 119.4 | 4.7 |

Various two-step artificial aging practices are completed on the alloys, the first step being completed at 290° F. (143.3° C.) for various times, as provided in Tables 3-4, below, the second step being 12 hours at 225° F. (107.2° C.). Various mechanical properties of the aged aluminum alloy plates are measured in accordance with ASTM E8 and B557, the results of which are provided in Table 3, below. Fracture toughness properties are also measured, the results of which are provided in Table 4, below.

TABLE 3

STRENGTH AND ELONGATION PROPERTIES OF PLATES

| Alloy | 1st step aging time at 290° F. (hours) | Orientation | Test plane | TYS (MPa) | UTS (MPa) | Elong. (%) |
|---|---|---|---|---|---|---|
| A | 20 | LT | T/4 | 442.6 | 499.2 | 14.0 |
| A | 31 | LT | T/4 | 439.9 | 499.9 | 13.6 |
| A | 44 | LT | T/4 | 476.5 | 525.4 | 10.3 |
| A | 60 | LT | T/4 | 488.3 | 535.0 | 9.8 |
| A | 20 | ST | T/2 | 408.9 | 500.6 | 6.3 |
| A | 31 | ST | T/2 | 426.1 | 513.7 | 6.2 |
| A | 44 | ST | T/2 | 450.9 | 530.0 | 5.1 |
| A | 60 | ST | T/2 | 455.2 | 534.3 | 4.3 |
| B | 20 | LT | T/4 | 428.5 | 486.1 | 10.0 |
| B | 31 | LT | T/4 | 433.3 | 491.3 | 11.1 |
| B | 44 | LT | T/4 | 467.1 | 515.8 | 8.7 |
| B | 60 | LT | T/4 | 477.5 | 526.1 | 6.9 |
| B | 20 | ST | T/2 | 414.0 | 481.9 | 4.7 |
| B | 31 | ST | T/2 | 425.4 | 487.1 | 4.7 |
| B | 44 | ST | T/2 | 441.4 | 505.4 | 3.1 |
| B | 60 | ST | T/2 | 452.1 | 512.1 | 2.7 |
| C-1 | 12 | LT | T/4 | 474.7 | 547.1 | 11.4 |
| C-1 | 24 | LT | T/4 | 514.0 | 570.9 | 7.9 |
| C-1 | 36 | LT | T/4 | 540.2 | 587.8 | 6.1 |

TABLE 3-continued

STRENGTH AND ELONGATION PROPERTIES OF PLATES

| Alloy | 1st step aging time at 290° F. (hours) | Orientation | Test plane | TYS (MPa) | UTS (MPa) | Elong. (%) |
|---|---|---|---|---|---|---|
| C-1 | 12 | ST | T/2 | 431.3 | 535.4 | 6.2 |
| C-1 | 24 | ST | T/2 | 464.0 | 545.0 | 3.1 |
| C-1 | 36 | ST | T/2 | 478.8 | 554.3 | 3.1 |
| C-2 | 6 | LT | T/4 | 387.8 | 497.5 | 11.1 |
| C-2 | 16 | LT | T/4 | 470.6 | 540.2 | 7.9 |
| C-2 | 26 | LT | T/4 | 501.9 | 562.3 | 3.6 |
| C-2 | 6 | ST | T/2 | 371.6 | 479.2 | 3.9 |
| C-2 | 16 | ST | T/2 | 457.1 | 533.3 | 3.1 |
| C-2 | 26 | ST | T/2 | 488.2 | 515.0 | 0.8 |
| D-1 | 6 | LT | T/4 | 389.6 | 498.5 | 14.3 |
| D-1 | 16 | LT | T/4 | 468.8 | 533.7 | 10.7 |
| D-1 | 26 | LT | T/4 | 493.3 | 553.3 | 7.5 |
| D-1 | 6 | ST | T/2 | 365.4 | 472.6 | 6.2 |
| D-1 | 16 | ST | T/2 | 406.1 | 459.9 | 4.7 |
| D-1 | 26 | ST | T/2 | 475.1 | 549.5 | 3.1 |
| D-2 | 12 | LT | T/4 | 467.5 | 526.1 | 5.7 |
| D-2 | 24 | LT | T/4 | 500.6 | 548.1 | 2.9 |
| D-2 | 36 | LT | T/4 | 533.0 | 563.3 | 2.9 |
| D-2 | 12 | ST | T/2 | 424.0 | 485.4 | 2.4 |
| D-2 | 24 | ST | T/2 | 453.0 | 508.5 | 1.6 |
| D-2 | 36 | ST | T/2 | 471.9 | 517.1 | 1.6 |

TABLE 4

FRACTURE TOUGHNESS PROPERTIES OF PLATES -T/2

| Alloy | 1st step aging time at 290° F. (hours) | $K_{IC}$ T-L (MPa√m) | $K_{IC}$ S-L (MPa√m) |
|---|---|---|---|
| A | 20 | — | 39.9 |
| A | 31 | 43.3 | 35.3 |
| A | 44 | 36.3 | 31.6 |
| A | 60 | 33.6 | 28.7 |
| B | 20 | 37.5 | 35.3 |
| B | 31 | 39.0 | 34.6** |
| B | 44 | 33.7 | 27.8 |
| B | 60 | 31.8 | 24.1 |
| C-1 | 12 | 29.1 | 25.2 |
| C-1 | 24 | 24.4 | 20.5 |
| C-1 | 36 | 21.5 | 16.3** |
| C-2 | 6 | 36.9 | 22.1 |
| C-2 | 16 | 27.5 | 19.6 |
| C-2 | 26 | 24.7 | 14.8 |
| D-1 | 6 | 42.0 | 30.9 |
| D-1 | 16 | 30.8 | 24.1 |
| D-1 | 26 | 25.8 | 21.0 |
| D-2 | 12 | 26.2 | 19.3 |
| D-2 | 24 | 22.8 | 15.3** |
| D-2 | 36 | 21.0 | 14.4** |

= $K_Q$ values, but representative of $K_{IC}$ values B = 25.4 mm, W = 50.8 mm, and a ≈ 25.4 mm FIGS. 1-4** illustrate the mechanical properties of the alloys. The invention alloys, of Example 1 centered around about 3.5 wt. % Cu, 0.20 wt. % Mg, and about 1.20 wt. % Li realize significantly better strength-toughness properties over the non-invention alloys.

The stress corrosion cracking resistance properties of many of the alloys are tested in accordance with ASTM G47. All of invention Alloys A-B, except one sample of alloy A (the sample aged for 31 hours during the first aging step), achieve no failures at a net stress of 241.3 MPa or 310.3 MPa over a period of over 100 days of testing. Alloys C and D achieve multiple failures over this same period under the same testing conditions. This is due to the fact that Alloys C and D require underaging to achieve good toughness, which makes them prone to corrosion. Alloys C and D could be aged further to improve corrosion, but toughness would decrease. Conversely, invention alloys A and B achieve a good combination of all three properties (strength, toughness and corrosion).

One alloy A sample (60 hours first step aging) is also tested at 379.2 MPa, along with one alloy A sample (44 hours first step aging) and two alloy B samples (44 and 60 hours first step aging). All of these alloys also pass the test at a net stress of 379.2 MPa, except one specimen of one alloy A (60 hours first step aging), which failed after 94 days of exposure. Many of the invention alloys are also tested for stress corrosion cracking resistance using a seacoast exposure test and at a net stress of 241.3, 310.3, and 379.2 MPa. None of the alloys fail the seacoast test after at least 250 days of exposure.

Example 2

Additional Plate Testing

Various Al—Li alloys are cast as rectangular ingots and homogenized with two ingots being produced per alloy. The scalped ingots had a thickness of 298 mm. The composition of each ingot is shown in Table 5, below. Alloys E-F are invention alloys. Alloy G is a non-invention alloy, and is similar to the alloy XXI disclosed in U.S. Pat. No. 5,259,897, which contained 3.5 wt. % Cu, 1.3 wt. % Li, 0.4 wt. % Mg, 0.14 wt. % Zr, 0.03 wt. % Ti, the balance being aluminum and impurities.

TABLE 5

COMPOSITION OF ALLOYS

| Alloy | Si | Fe | Cu | Mg | Mn | Zn | Ti | Zr | Li |
|---|---|---|---|---|---|---|---|---|---|
| E | 0.03 | 0.04 | 3.27 | 0.25 | 0.24 | 0.38 | 0.02 | 0.11 | 1.21 |
| F | 0.03 | 0.04 | 3.27 | 0.26 | 0.24 | 0.31 | 0.02 | 0.11 | 1.19 |
| G | 0.02 | 0.03 | 3.48 | 0.39 | 0.01 | 0.02 | 0.02 | 0.11 | 1.29 |

The balance of each alloy is aluminum and other elements, with no one other element exceeding 0.05 wt. %, and with the total of these other elements not exceeding 0.15 wt. %. The alloys are hot rolled, solution heat treated, quenched and stretched about 6%. Alloys E and G are rolled to two different gauges. The approximate final gauges are provided in Table 6, below.

TABLE 6

ALLOYS AND FINAL GAUGE

| Alloy | Final Gauge (mm) | Final Gauge (in.) |
|---|---|---|
| E-1 | 63 | 2.48 |
| E-2 | 102 | 4.02 |
| F | 125 | 4.92 |
| G-1 | 63 | 2.48 |
| G-2 | 102 | 4.02 |

Various two-step artificial aging practices are completed on the alloys, the first step being completed at 290° F. (143.3° C.) for various times, as provided in Table 7, below, the second step being 12 hours at 225° F. (107.2° C.). Various mechanical properties of the aged aluminum alloy plates are measured in accordance with ASTM E8 and B557, the results of which are provided in Tables 7, 9, and 11, below. Fracture toughness properties are also measured, the results of which are provided in Tables 8, 10, and 12, below.

TABLE 7

YIELD STRENGTH PROPERTIES OF 63 MILLIMETER PLATES

| Alloy | 1st step aging time at 290° F. (hours) | Orientation | Test plane | TYS (MPa) | UTS (MPa) | Elong. (%) |
|---|---|---|---|---|---|---|
| E-1 | 24 | LT | T/4 | 442 | 496 | 14.3 |
| E-1 | 42 | LT | T/4 | 478 | 525 | 11.4 |
| E-1 | 60 | LT | T/4 | 490 | 534 | 8.6 |
| E-1 | 72 | LT | T/4 | 490 | 536 | 10 |
| G-1 | 24 | LT | T/4 | 462 | 521 | 11.4 |
| G-1 | 42 | LT | T/4 | 502 | 552 | 8.6 |
| G-1 | 60 | LT | T/4 | 514 | 563 | 7.1 |
| G-1 | 72 | LT | T/4 | 519 | 567 | 5.7 |
| E-1 | 24 | ST | T/2 | 438 | 520 | 6 |
| E-1 | 42 | ST | T/2 | 459 | 538 | 4.3 |
| E-1 | 60 | ST | T/2 | 466 | 538 | 3.2 |
| E-1 | 72 | ST | T/2 | 473 | 547 | 2.9 |
| G-1 | 24 | ST | T/2 | 451 | 540 | 3.6 |
| G-1 | 42 | ST | T/2 | 479 | 560 | 1.8 |
| G-1 | 60 | ST | T/2 | 485 | 552 | 0.9 |
| G-1 | 72 | ST | T/2 | 486 | 534 | 0.6 |

TABLE 8

FRACTURE TOUGHNESS PROPERTIES OF 63 MILLIMETER PLATES

| Alloy | 1st step aging time at 290° F. (hours) | Orientation | Test plane | $K_{IC}$ (MPa√m) |
|---|---|---|---|---|
| E-1 | 24 | T-L | T/2 | 37.0 |
| E-1 | 42 | T-L | T/2 | 31.8 |
| E-1 | 60 | T-L | T/2 | 30.5 |
| E-1 | 72 | T-L | T/2 | — |
| G-1 | 24 | T-L | T/2 | 31.7 |
| G-1 | 42 | T-L | T/2 | 26.2 |
| G-1 | 60 | T-L | T/2 | — |
| G-1 | 72 | T-L | T/2 | — |
| E-1 | 24 | S-L | T/2 | 31.1 |
| E-1 | 42 | S-L | T/2 | 26.5 |
| E-1 | 60 | S-L | T/2 | 25.2 |
| E-1 | 72 | S-L | T/2 | 24.3 |
| G-1 | 24 | S-L | T/2 | 23.7 |
| G-1 | 42 | S-L | T/2 | 21.1 |
| G-1 | 60 | S-L | T/2 | 17.4 |
| G-1 | 72 | S-L | T/2 | 17.8 |

TABLE 9

YIELD STRENGTH PROPERTIES OF 102 MILLIMETER PLATES

| Alloy | 1st step aging time at 290° F. (hours) | Orientation | Test plane | TYS (MPa) | UTS (MPa) | Elong. (%) |
|---|---|---|---|---|---|---|
| E-2 | 42 | LT | T/4 | 470 | 520 | 6.4 |
| E-2 | 60 | LT | T/4 | 483 | 530 | 5.7 |
| E-2 | 72 | LT | T/4 | 485 | 532 | 6.4 |
| G-2 | 24 | LT | T/4 | 443 | 505 | 9 |
| G-2 | 42 | LT | T/4 | 489 | 540 | 5 |
| G-2 | 60 | LT | T/4 | 504 | 553 | 4.3 |
| G-2 | 72 | LT | T/4 | 505 | 554 | 5 |
| E-2 | 42 | ST | T/2 | 444 | 505 | 2.4 |
| E-2 | 60 | ST | T/2 | 452 | 509 | 1.9 |
| E-2 | 72 | ST | T/2 | 451 | 508 | 1.7 |
| G-2 | 24 | ST | T/2 | 430 | 504 | 2.3 |
| G-2 | 42 | ST | T/2 | 467 | 533 | 1.7 |
| G-2 | 60 | ST | T/2 | 473 | 525 | 1.2 |
| G-2 | 72 | ST | T/2 | 472 | 525 | 1.2 |

TABLE 10

FRACTURE TOUGHNESS PROPERTIES OF 102 MILLIMETER PLATES

| Alloy | 1st step aging time at 290° F. (hours) | Orientation | Test plane | $K_{IC}$ (MPa√m) |
|---|---|---|---|---|
| E-2 | 42 | T-L | T/2 | 29.0 |
| E-2 | 60 | T-L | T/2 | 27.5 |
| E-2 | 72 | T-L | T/2 | — |
| G-2 | 24 | T-L | T/2 | 29.9 |
| G-2 | 42 | T-L | T/2 | 25.2 |
| G-2 | 60 | T-L | T/2 | — |
| G-2 | 72 | T-L | T/2 | — |
| E-2 | 42 | S-L | T/2 | 23.6 |
| E-2 | 60 | S-L | T/2 | 23.4 |
| E-2 | 72 | S-L | T/2 | 23.5 |
| G-2 | 24 | S-L | T/2 | 21.8 |
| G-2 | 42 | S-L | T/2 | 16.0 |
| G-2 | 60 | S-L | T/2 | 17.3 |
| G-2 | 72 | S-L | T/2 | 14.9 |

TABLE 11

YIELD STRENGTH PROPERTIES OF 125 MILLIMETER PLATES

| Alloy | 1st step aging time at 290° F. (hours) | Orientation | Test plane | TYS (MPa) | UTS (MPa) | Elong. (%) |
|---|---|---|---|---|---|---|
| F | 42 | LT | T/4 | 458 | 506 | 6.4 |
| F | 60 | LT | T/4 | 469 | 515 | 5.4 |
| F | 72 | LT | T/4 | 471 | 517 | 5.7 |
| F | 42 | ST | T/2 | 432 | 480 | 1.6 |
| F | 60 | ST | T/2 | 441 | 489 | 1.7 |
| F | 72 | ST | T/2 | 445 | 489 | 1.6 |

TABLE 12

FRACTURE TOUGHNESS PROPERTIES OF 125 MILLIMETER PLATES

| Alloy | 1st step aging time at 290° F. (hours) | Orientation | Test plane | $K_{IC}$ (MPa√m) |
|---|---|---|---|---|
| F | 42 | T-L | T/2 | 31.4 |
| F | 60 | T-L | T/2 | 29.5 |
| F | 72 | T-L | T/2 | — |
| F | 42 | S-L | T/2 | 24.0 |
| F | 60 | S-L | T/2 | 22.2 |
| F | 72 | S-L | T/2 | 20.8 |

As illustrated in FIGS. 5 and 7, invention alloy E realizes an improved strength-toughness trend in the long-transverse direction relative to prior art alloy G. As illustrated in FIGS. 6*a* and 8, invention alloy E realizes an improved strength-toughness trend in the short-transverse direction relative to prior art alloy G. With respect to the short-transverse direction, and as illustrated in FIG. 6*a*, at about equivalent strength alloy E realizes about a 17% improvement in toughness compared to alloy G. At about equivalent toughness alloy E realizes about 5% better strength as compared to alloy G. Similar results are realized relative to the plates having a thickness of 102 mm (FIG. 8).

An example minimum short-transverse performance line for 50.8-76.2 mm thick products is illustrated in FIG. 6*b*. This example minimum performance line is based on the 63.5 mm ST data of alloy E. As illustrated in FIG. 6*b*, the minimum performance line requires that a 50.8-76.2 mm thick aluminum alloy plate product realizes a strength-toughness relationship that satisfies the following expression:

$$FT\text{-}SL \geq -0.199(TYS\text{-}ST)+116$$

wherein TYS-ST is the ST tensile yield strength of the plate in MPa as measured in accordance with ASTM Standard E8 and ASTM B557, and where FT is the S-L plane strain fracture toughness ($K_{IC}$) of the plate in MPa√m as measured in accordance with ASTM E399. The minimum performance line requires that the wrought aluminum alloy product realize a TYS-ST of at least 400 MPa, and a FT-SL of at least 22 MPa√m. In one embodiment, the intercept of this minimum performance line is 116.5. In another embodiment, the intercept of this minimum performance line is 117. In yet another embodiment, the intercept of this minimum performance line is 117.5. In another embodiment, the intercept of this minimum performance line is 118.

As illustrated in FIGS. 9-10, thicker alloy products also achieve improved properties. Invention alloy F in plate form and having a thickness of 125 mm achieves an improved strength-toughness combination over non-invention alloy D-2 in plate form and having a thickness of 119.4 mm.

The stress corrosion cracking resistance properties of invention plate alloys E-F are tested in accordance with ASTM G47 in the ST direction at mid-thickness. All of invention Alloys E-F achieve no failures at a net stress of 310.3 MPa and 379.2 MPa over a period of over 60 days of testing.

Example 3

Forged Products

An Al—Li alloy is cast as an rectangular ingot and homogenized, the composition of which is shown in Table 13, below. The scalped ingot had a thickness of 356 mm. Alloy H is an invention alloy.

TABLE 13

COMPOSITION OF ALLOY

| Alloy | Si | Fe | Cu | Mg | Mn | Zn | Ti | Zr | Li |
|---|---|---|---|---|---|---|---|---|---|
| H | 0.02 | 0.03 | 3.50 | 0.21 | 0.30 | 0.35 | 0.02 | 0.13 | 1.18 |

The balance of the alloy is aluminum and other elements, with no one other element exceeding 0.03 wt. %, and with the total of these other elements not exceeding 0.12 wt. %. Several die forgings are produced from the ingot and in the T852 temper (i.e., hot forged to gauge, solution heat treated, quenched, cold worked about 6%, and then aged), after which the mechanical properties are measured. The results are provided in Table 14, below.

TABLE 14

PROPERTIES OF DIE FORGED ALLOY

| Gauge | 25.4 mm | | 50.8 mm | | 76.2 mm | |
|---|---|---|---|---|---|---|
| 1st Step Age | 24 hrs @ 290 F. | 48 hrs @ 290 F. | 24 hrs @ 290 F. | 48 hrs @ 290 F. | 24 hrs @ 290 F. | 48 hrs @ 290 F. |
| $2^{nd}$ Step Age | 12 hrs @ 225 F. | 12 hrs @ 225 F. | 12 hrs @ 225 F. | 12 hrs @ 225 F. | 12 hrs @ 225 F. | 12 hrs @ 225 F. |
| TYS, LT (MPa) | 496.4 | 517.1 | 475.7 | 503.3 | 468.8 | 496.4 |
| UTS, LT (MPa) | 530.9 | 551.6 | 517.1 | 537.8 | 510.2 | 530.9 |
| Elong., LT (%) | 14 | 14 | 14 | 13 | 9 | 6 |
| TYS, ST (MPa) | — | — | 413.7 | 434.4 | 413.7 | 434.4 |
| UTS, ST (MPa) | — | — | 482.6 | 503.3 | 468.8 | 496.4 |
| Elong., ST (%) | — | — | 10 | 10 | 10 | 10 |
| $K_{IC}$, T-L (MPa√m) | 50.5 | 46.2 | 47.3 | 35.2 | 40.7 | 26.4 |
| $K_{IC}$, S-L (MPa√m) | — | — | 41.8 | 36.3 | 38.5 | 31.9 |

As shown in FIGS. 11-12, the invention alloy realizes a good combination of strength-toughness. As shown in FIGS. 13*a*-14*b*, the invention alloys realize similar properties in both die forged and plate form (includes Example 1-3). FIGS. 13*a*-13*b* illustrate the performance between the 63 mm plates and the 50.8 mm die forging. As shown, the trends are similar. Thus, forged and extruded wrought products made from the invention alloys are expected to achieve similar properties to similarly sized plate products made from the invention alloys. Thus, the minimum performance line of FIG. 6*b* is expected to be applicable to all wrought products having a thickness of from 50.8 to 76.2 mm. FIG. 13*c* illustrates the combined performance of the 50.8 mm forging and the 63 mm plates as compared to non-invention alloys C-1 and G. FIG. 14*a*-14*b* illustrates the performance of the 101.6 mm invention plates and die forging, respectively. FIG. 14*c* illustrates the combined performance of the 101.6 mm invention plates and die forging as compared to non-invention alloys C-2 and G.

The results of Examples 1-3 indicate that the amount of Cu, Mg and Li should be tailored such that the alloy composition conforms to the following expression:

$$-0.3*Mg-0.15Cu+1.65 \leq Li \leq -0.3*Mg-0.15Cu+1.85 \quad (1)$$

This is illustrated in FIGS. 15*a*-15*c*. As Cu and/or Mg are increased, the alloys may tend to be more quench sensitive. The amount of lithium that can be used may be affected by such quench sensitivity, and this formula takes into account Cu and Mg variations so as to facilitate production of thick products having good strength-toughness properties.

The stress corrosion cracking resistance properties of alloy H is tested in accordance with ASTM G47 in the ST direction at mid-thickness of the 50.8 and 101.6 mm thick forgings. These forgings achieve no failures at a net stress of 241.3 MPa and 310.3 MPa over a period of over 100 days of testing. The same forgings are also tested for stress corrosion cracking resistance when subjected to seacoast environment SCC testing at a net stress of 241.3 MPa and 310.3 MPa. None of the alloys fail the seacoast test after at least 150 days of exposure. The specimens for the seacoast environment SCC testing are tested in constant strain fixtures (e.g., similar to those use in accelerated laboratory SCC testing). The seacoast SCC testing conditions include continuously exposing the samples via racks to a seacoast environment, where the samples are about 1.5 meters from the ground, the samples are oriented 45° from the horizontal, and with a face of the sample facing the prevailing winds. The samples are located about 100 meters from the coastline. In one embodiment, the coastline is of a rocky nature, with the prevailing winds oriented toward the samples so as to provide an aggressive salt-mist exposure (e.g., a location similar to the seacoast exposure station, Pt. Judith, R.I., USA of Alcoa Inc.).

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. An aluminum alloy product, the aluminum alloy consisting of:

from 3.20 to 3.60 wt. % Cu;

from 0.15 to 0.30 wt. % Mg;

from 1.05 to 1.25 wt. % Li;

from 0.05 to 0.50 wt. % of at least one grain structure control element, wherein the at least one grain structure control element is selected from the group consisting of Zr, Sc, Cr, V, Hf, and combinations thereof;

from 0.20 to 1.0 wt. % Zn;

from 0.2 to 0.5 wt. % Mn;

up to 0.12 wt. % Si;

up to 0.15 wt. % Fe;

up to 0.15 wt. % Ti;

up to 0.05 wt. % of any other element, with the total of these other elements not exceeding 0.15 wt. %, wherein the other elements include silver (Ag); and the balance being aluminum, wherein the aluminum alloy product has a thickness of 50.8-76.2 mm and realizes a strength-toughness relationship that satisfies the expression:

$$FT\text{-}SL \geq -0.199(TYS-ST)+116;$$

wherein TYS-ST is the ST tensile yield strength of the plate in MPa as measured in accordance with ASTM Standard E8 and ASTM B557, wherein FT-SL is the S-L plane strain fracture toughness (KIC) of the plate in MPa√Vm as measured in accordance with ASTM E399, wherein the aluminum alloy product realizes a TYS-ST of at least 400 MPa, and wherein the aluminum alloy product realizes a FT-SL of at least about 22 MPa√m.

2. The aluminum alloy product of claim 1, wherein the grain structure control element is at least Zr, and wherein the alloy contains 0.05 to 0.20 wt. % Zr.

3. The aluminum alloy product of claim 1, comprising at least 3.40 wt. % Cu.

4. The aluminum alloy product of claim 1, comprising not greater than 0.25 wt. % Mg.

5. The aluminum alloy product of claim 4, comprising at least 1.150 wt. % Li.

6. The aluminum alloy product of claim 4, comprising not greater than 0.50 wt. % Zn.

* * * * *